US008556701B2

(12) United States Patent
Falciglia, Sr.

(10) Patent No.: US 8,556,701 B2
(45) **Date of Patent: *Oct. 15, 2013**

(54) BINGO-TYPE MATCHING GAME

(71) Applicant: Sal Falciglia, Sr., Ridgewood, NJ (US)

(72) Inventor: Sal Falciglia, Sr., Ridgewood, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/672,414

(22) Filed: Nov. 8, 2012

(65) Prior Publication Data

US 2013/0130767 A1 May 23, 2013

Related U.S. Application Data

(63) Continuation-in-part of application No. 13/024,118, filed on Feb. 9, 2011, now Pat. No. 8,337,291, which is a continuation-in-part of application No. 11/580,728, filed on Oct. 13, 2006, now Pat. No. 7,993,193.

(60) Provisional application No. 60/786,857, filed on Mar. 29, 2006.

(51) Int. Cl.
*A63F 9/24* (2006.01)

(52) U.S. Cl.
USPC ..... 463/19

(58) Field of Classification Search
USPC ..... 463/16–20, 22
See application file for complete search history.

(56) References Cited

U.S. PATENT DOCUMENTS 4,743,024 A 5/1988 Helm et al.
4,953,869 A 9/1990 Muhammad
5,351,970 A 10/1994 Fioretti
5,393,057 A 2/1995 Marnell, II
5,411,258 A 5/1995 Wilson et al.
5,647,798 A 7/1997 Falciglia
5,695,400 A 12/1997 Fennell, Jr. et al.
5,772,510 A 6/1998 Roberts
5,882,260 A 3/1999 Marks et al.
5,935,002 A 8/1999 Falciglia
5,971,849 A 10/1999 Falciglia
6,190,255 B1 2/2001 Thomas et al.
6,280,328 B1 8/2001 Holch et al.
6,322,445 B1 11/2001 Miller
6,461,241 B1 10/2002 Webb et al.
6,565,044 B1 * 5/2003 Johnson et al. ..... 244/171.5
6,585,587 B2 7/2003 Falciglia, Sr.
6,612,578 B2 9/2003 Falciglia, Sr.
6,656,044 B1 12/2003 Lewis
6,764,398 B2 7/2004 Stone et al.
6,845,980 B2 1/2005 Falciglia, Sr.

(Continued)

FOREIGN PATENT DOCUMENTS

EP 0464935 3/1992
GB 2137392 6/1984

*Primary Examiner* — David L Lewis
*Assistant Examiner* — Eric M Thomas
(74) *Attorney, Agent, or Firm* — Weide & Miller, Ltd.

(57) ABSTRACT

A matching game involves attempting to match one or more sets of base symbols with two or more sets of player symbols, such as player symbols in two matrices. In a single player variation, a player attempts to achieve combinations of matches. One or more winning combinations comprise matches of all symbols along contiguous rows, columns or diagonals of two or more of the matrices. In a multi-player variation, individual players attempt to achieve patterns of matches across their own matrix and combinations of contiguous matches spanning the matrices of two or more of the players.

20 Claims, 29 Drawing Sheets

(56) References Cited

U.S. PATENT DOCUMENTS

| | | | | |
|---|---|---|---|---|
| 6,994,625 | B2 | 2/2006 | Falciglia, Sr. | |
| 6,997,806 | B2 | 2/2006 | Falciglia, Sr. | |
| 7,137,883 | B1 | 11/2006 | Falciglia, Sr. | |
| 7,201,657 | B2 | 4/2007 | Baerlocher et al. | |
| 7,316,397 | B2 | 1/2008 | Friedman | |
| 7,500,915 | B2 | 3/2009 | Wolf et al. | |
| 7,717,786 | B1 | 5/2010 | Falciglia, Sr. | |
| 7,753,782 | B2 | 7/2010 | Cuddy et al. | |
| 7,789,755 | B2 | 9/2010 | Davis et al. | |
| 7,993,193 | B2 | 8/2011 | Falciglia | |
| 8,337,291 | B2 | 12/2012 | Falciglia, Sr. | |
| 2002/0055381 | A1 | 5/2002 | Tarantino | |
| 2002/0055382 | A1 | 5/2002 | Meyer | |
| 2002/0160827 | A1 | 10/2002 | Slomiany et al. | |
| 2003/0017867 | A1 | 1/2003 | deKeller | |
| 2003/0181234 | A1 | 9/2003 | Falciglia, Sr. | |
| 2003/0207707 | A1 | 11/2003 | Slomiany et al. | |
| 2004/0009806 | A1* | 1/2004 | Odom | 463/19 |
| 2004/0121834 | A1* | 6/2004 | Libby et al. | 463/19 |
| 2005/0159208 | A1 | 7/2005 | Pacey | |
| 2005/0250578 | A1 | 11/2005 | Slomiany et al. | |
| 2006/0017227 | A1 | 1/2006 | Falciglia, Sr. | |
| 2006/0035699 | A1 | 2/2006 | Falciglia, Sr. | |
| 2006/0135242 | A1 | 6/2006 | Tarantino | |
| 2007/0167217 | A1 | 7/2007 | Kaminkow et al. | |
| 2007/0167238 | A1 | 7/2007 | Gatto et al. | |
| 2008/0139286 | A1 | 6/2008 | Post | |
| 2008/0176650 | A1 | 7/2008 | Wolf et al. | |
| 2010/0029363 | A1 | 2/2010 | Hoffman et al. | |
| 2010/0203948 | A1 | 8/2010 | Falciglia, Sr. | |
| 2011/0151957 | A1 | 6/2011 | Falciglia, Sr. | |
| 2011/0230251 | A1 | 9/2011 | Nicely et al. | |
| 2011/0294567 | A1 | 12/2011 | Falciglia | |

* cited by examiner

PAYOUTS

CARD 1

BONUS PAYOUTS

| BET PER CARD =1 | BET PER CARD =2 | BET PER CARD =4 | BET PER CARD =8 |
|---|---|---|---|
| 5 GOLD COINS – 500 | 5 GOLD COINS – 1,000 | 5 GOLD COINS – 2,000 | 5 GOLD COINS – 4,000 |
| 4 GOLD COINS – 25 | 4 GOLD COINS – 50 | 4 GOLD COINS – 100 | 4 GOLD COINS – 200 |
| 3 GOLD COINS – 5 | 3 GOLD COINS – 10 | 3 GOLD COINS – 20 | 3 GOLD COINS – 40 |
| 2 GOLD COINS – 1 | 2 GOLD COINS – 2 | 2 GOLD COINS – 4 | 2 GOLD COINS – 8 |
| 5 JOKERS – 10 | 5 JOKERS – 20 | 5 JOKERS – 40 | 5 JOKERS – 80 |

REGULAR PAYOUTS

| BET/CARD =3 | BET/CARD =6 | BET/CARD =9 | BET PER CARD =8 |
|---|---|---|---|
| HORIZONTAL SLINGO – 1 | HORIZONTAL SLINGO – 2 | HORIZONTAL SLINGO – 4 | HORIZONTAL SLINGO – 8 |
| VERTICAL SLINGO – 1 | VERTICAL SLINGO – 2 | VERTICAL SLINGO – 4 | VERTICAL SLINGO – 8 |
| DIAGONAL SLINGO – 1 | DIAGONAL SLINGO – 2 | DIAGONAL SLINGO – 4 | DIAGONAL SLINGO – 8 |
| FULL CARD – 100 | FULL CARD – 200 | FULL CARD – 400 | FULL CARD – 800 |

CARD 2

BONUS PAYOUTS

| BET PER CARD =1 | BET PER CARD =2 | BET PER CARD =4 | BET PER CARD =8 |
|---|---|---|---|
| 5 GOLD COINS – 500 | 5 GOLD COINS – 1,000 | 5 GOLD COINS – 2,000 | 5 GOLD COINS – 4,000 |
| 4 GOLD COINS – 25 | 4 GOLD COINS – 50 | 4 GOLD COINS – 100 | 4 GOLD COINS – 200 |
| 3 GOLD COINS – 5 | 3 GOLD COINS – 10 | 3 GOLD COINS – 20 | 3 GOLD COINS – 40 |
| 2 GOLD COINS – 1 | 2 GOLD COINS – 2 | 2 GOLD COINS – 4 | 2 GOLD COINS – 8 |
| 5 JOKERS – 10 | 5 JOKERS – 20 | 5 JOKERS – 40 | 5 JOKERS – 80 |

REGULAR PAYOUTS

| BET/CARD =1 | BET/CARD =2 | BET/CARD =4 | BET PER CARD =8 |
|---|---|---|---|
| HORIZONTAL SLINGO – 1 | HORIZONTAL SLINGO – 2 | HORIZONTAL SLINGO – 4 | HORIZONTAL SLINGO – 8 |
| VERTICAL SLINGO – 1 | VERTICAL SLINGO – 2 | VERTICAL SLINGO – 4 | VERTICAL SLINGO – 8 |
| DIAGONAL SLINGO – 1 | DIAGONAL SLINGO – 2 | DIAGONAL SLINGO – 4 | DIAGONAL SLINGO – 8 |
| FULL CARD – 100 | FULL CARD – 200 | FULL CARD – 400 | FULL CARD – 800 |
| LONG HORIZONTAL COVERS (10) – 3 | LONG HORIZONTAL COVERS (10) – 6 | LONG HORIZONTAL COVERS (10) – 12 | LONG HORIZONTAL COVERS (10) – 24 |

FIG. 10A

CARD 3

BONUS PAYOUTS

| BET PER CARD =1 | BET PER CARD =2 | BET PER CARD =4 | BET PER CARD =8 |
|---|---|---|---|
| 5 GOLD COINS – 500 | 5 GOLD COINS – 1,000 | 5 GOLD COINS – 2,000 | 5 GOLD COINS – 4,000 |
| 4 GOLD COINS – 25 | 4 GOLD COINS – 50 | 4 GOLD COINS – 100 | 4 GOLD COINS – 200 |
| 3 GOLD COINS – 5 | 3 GOLD COINS – 10 | 3 GOLD COINS – 20 | 3 GOLD COINS – 40 |
| 2 GOLD COINS – 1 | 2 GOLD COINS – 2 | 2 GOLD COINS – 4 | 2 GOLD COINS – 8 |
| 5 JOKERS – 10 | 5 JOKERS – 20 | 5 JOKERS – 40 | 5 JOKERS – 80 |

REGULAR PAYOUTS

| BET/CARD =1 | BET/CARD =2 | BET/CARD =4 | BET PER CARD =8 |
|---|---|---|---|
| HORIZONTAL SLINGO – 1 | HORIZONTAL SLINGO – 2 | HORIZONTAL SLINGO – 4 | HORIZONTAL SLINGO – 8 |
| VERTICAL SLINGO – 1 | VERTICAL SLINGO – 2 | VERTICAL SLINGO – 4 | VERTICAL SLINGO – 8 |
| DIAGONAL SLINGO – 1 | DIAGONAL SLINGO – 2 | DIAGONAL SLINGO – 4 | DIAGONAL SLINGO – 8 |
| FULL CARD – 100 | FULL CARD – 200 | FULL CARD – 400 | FULL CARD – 800 |
| LONG HORIZONTAL COVERS (10) – 3 | LONG HORIZONTAL COVERS (10) – 6 | LONG HORIZONTAL COVERS (10) – 12 | LONG HORIZONTAL COVERS (10) – 24 |
| LONG DIAGONAL COVERS (10) – 3 | LONG DIAGONAL COVERS (10) – 6 | LONG DIAGONAL COVERS (10) – 12 | LONG DIAGONAL COVERS (10) – 24 |

CARD 4

BONUS PAYOUTS

| BET PER CARD =1 | BET PER CARD =2 | BET PER CARD =4 | BET PER CARD =8 |
|---|---|---|---|
| 5 GOLD COINS – 500 | 5 GOLD COINS – 1,000 | 5 GOLD COINS – 2,000 | 5 GOLD COINS – 4,000 |
| 4 GOLD COINS – 25 | 4 GOLD COINS – 50 | 4 GOLD COINS – 100 | 4 GOLD COINS – 200 |
| 3 GOLD COINS – 5 | 3 GOLD COINS – 10 | 3 GOLD COINS – 20 | 3 GOLD COINS – 40 |
| 2 GOLD COINS – 1 | 2 GOLD COINS – 2 | 2 GOLD COINS – 4 | 2 GOLD COINS – 8 |
| 5 JOKERS – 10 | 5 JOKERS – 20 | 5 JOKERS – 40 | 5 JOKERS – 80 |

REGULAR PAYOUTS

| BET/CARD =1 | BET/CARD =2 | BET/CARD =4 | BET PER CARD =8 |
|---|---|---|---|
| HORIZONTAL SLINGO – 1 | HORIZONTAL SLINGO – 2 | HORIZONTAL SLINGO – 4 | HORIZONTAL SLINGO – 8 |
| VERTICAL SLINGO – 1 | VERTICAL SLINGO – 2 | VERTICAL SLINGO – 4 | VERTICAL SLINGO – 8 |
| DIAGONAL SLINGO – 1 | DIAGONAL SLINGO – 2 | DIAGONAL SLINGO – 4 | DIAGONAL SLINGO – 8 |
| FULL CARD – 100 | FULL CARD – 200 | FULL CARD – 400 | FULL CARD – 800 |
| LONG HORIZONTAL COVERS (10) – 3 | LONG HORIZONTAL COVERS (10) – 6 | LONG HORIZONTAL COVERS (10) – 12 | LONG HORIZONTAL COVERS (10) – 24 |
| LONG DIAGONAL COVERS (10) – 3 | LONG DIAGONAL COVERS (10) – 6 | LONG DIAGONAL COVERS (10) – 12 | LONG DIAGONAL COVERS (10) – 24 |

FIG. 10B

CARD 1

BONUS PAYOUTS

| BET PER CARD =1 | BET PER CARD =2 | BET PER CARD =4 | BET PER CARD =8 |
|---|---|---|---|
| 5 GOLD COINS – 1,000 | 5 GOLD COINS – 2,000 | 5 GOLD COINS – 4,000 | 5 GOLD COINS – 8,000 |
| 4 GOLD COINS – 60 | 4 GOLD COINS – 120 | 4 GOLD COINS – 240 | 4 GOLD COINS – 480 |
| 3 GOLD COINS – 5 | 3 GOLD COINS – 10 | 3 GOLD COINS – 20 | 3 GOLD COINS – 40 |
| 2 GOLD COINS – 1 | 2 GOLD COINS – 2 | 2 GOLD COINS – 4 | 2 GOLD COINS – 8 |
| 5 JOKERS – 40 | 5 JOKERS – 80 | 5 JOKERS – 160 | 5 JOKERS – 320 |

REGULAR PAYOUTS

| BET/CARD =1 | BET/CARD =2 | BET/CARD =4 | BET PER CARD =8 |
|---|---|---|---|
| HORIZONTAL SLINGO – 1 | HORIZONTAL SLINGO – 2 | HORIZONTAL SLINGO – 4 | HORIZONTAL SLINGO – 8 |
| VERTICAL SLINGO – 1 | VERTICAL SLINGO – 2 | VERTICAL SLINGO – 4 | VERTICAL SLINGO – 8 |
| DIAGONAL SLINGO – 1 | DIAGONAL SLINGO – 2 | DIAGONAL SLINGO – 4 | DIAGONAL SLINGO – 8 |
| FULL CARD – 400 | FULL CARD – 800 | FULL CARD – 1,600 | FULL CARD – 3,200 |

CARD 2

BONUS PAYOUTS

| BET PER CARD =1 | BET PER CARD =2 | BET PER CARD =4 | BET PER CARD =8 |
|---|---|---|---|
| 5 GOLD COINS – 1,000 | 5 GOLD COINS – 2,000 | 5 GOLD COINS – 4,000 | 5 GOLD COINS – 8,000 |
| 4 GOLD COINS – 60 | 4 GOLD COINS – 120 | 4 GOLD COINS – 240 | 4 GOLD COINS – 480 |
| 3 GOLD COINS – 5 | 3 GOLD COINS – 10 | 3 GOLD COINS – 20 | 3 GOLD COINS – 40 |
| 2 GOLD COINS – 1 | 2 GOLD COINS – 2 | 2 GOLD COINS – 4 | 2 GOLD COINS – 8 |
| 5 JOKERS – 40 | 5 JOKERS – 80 | 5 JOKERS – 160 | 5 JOKERS – 320 |

REGULAR PAYOUTS

| BET/CARD =1 | BET/CARD =2 | BET/CARD =4 | BET PER CARD =8 |
|---|---|---|---|
| HORIZONTAL SLINGO – 1 | HORIZONTAL SLINGO – 2 | HORIZONTAL SLINGO – 4 | HORIZONTAL SLINGO – 8 |
| VERTICAL SLINGO – 1 | VERTICAL SLINGO – 2 | VERTICAL SLINGO – 4 | VERTICAL SLINGO – 8 |
| DIAGONAL SLINGO – 1 | DIAGONAL SLINGO – 2 | DIAGONAL SLINGO – 4 | DIAGONAL SLINGO – 8 |
| FULL CARD – 400 | FULL CARD – 800 | FULL CARD – 1,600 | FULL CARD – 3,200 |
| LONG HORIZONTAL COVERS (10) – 5 | LONG HORIZONTAL COVERS (10) – 10 | LONG HORIZONTAL COVERS (10) – 20 | LONG HORIZONTAL COVERS (10) – 40 |

FIG. 11A

CARD 3

BONUS PAYOUTS

| BET PER CARD =1 | BET PER CARD =2 | BET PER CARD =4 | BET PER CARD =8 |
|---|---|---|---|
| 5 GOLD COINS – 1,000 | 5 GOLD COINS – 2,000 | 5 GOLD COINS – 4,000 | 5 GOLD COINS – 8,000 |
| 4 GOLD COINS – 60 | 4 GOLD COINS – 120 | 4 GOLD COINS – 240 | 4 GOLD COINS – 480 |
| 3 GOLD COINS – 5 | 3 GOLD COINS – 10 | 3 GOLD COINS – 20 | 3 GOLD COINS – 40 |
| 2 GOLD COINS – 1 | 2 GOLD COINS – 2 | 2 GOLD COINS – 4 | 2 GOLD COINS – 8 |
| 5 JOKERS – 40 | 5 JOKERS – 80 | 5 JOKERS – 160 | 5 JOKERS – 320 |

REGULAR PAYOUTS

| BET/CARD =1 | BET/CARD =2 | BET/CARD =4 | BET PER CARD =8 |
|---|---|---|---|
| HORIZONTAL SLINGO – 1 | HORIZONTAL SLINGO – 2 | HORIZONTAL SLINGO – 4 | HORIZONTAL SLINGO – 8 |
| VERTICAL SLINGO – 1 | VERTICAL SLINGO – 2 | VERTICAL SLINGO – 4 | VERTICAL SLINGO – 8 |
| DIAGONAL SLINGO – 1 | DIAGONAL SLINGO – 2 | DIAGONAL SLINGO – 4 | DIAGONAL SLINGO – 8 |
| FULL CARD – 400 | FULL CARD – 800 | FULL CARD – 1,600 | FULL CARD – 3,200 |
| LONG HORIZONTAL COVERS (10) – 5 | LONG HORIZONTAL COVERS (10) – 10 | LONG HORIZONTAL COVERS (10) – 20 | LONG HORIZONTAL COVERS (10) – 40 |
| LONG DIAGONAL COVERS (10) – 5 | LONG DIAGONAL COVERS (10) – 10 | LONG DIAGONAL COVERS (10) – 20 | LONG DIAGONAL COVERS (10) – 40 |

CARD 4

BONUS PAYOUTS

| BET PER CARD =1 | BET PER CARD =2 | BET PER CARD =4 | BET PER CARD =8 |
|---|---|---|---|
| 5 GOLD COINS – 1,000 | 5 GOLD COINS – 2,000 | 5 GOLD COINS – 4,000 | 5 GOLD COINS – 8,000 |
| 4 GOLD COINS – 60 | 4 GOLD COINS – 120 | 4 GOLD COINS – 240 | 4 GOLD COINS – 480 |
| 3 GOLD COINS – 5 | 3 GOLD COINS – 10 | 3 GOLD COINS – 20 | 3 GOLD COINS – 40 |
| 2 GOLD COINS – 1 | 2 GOLD COINS – 2 | 2 GOLD COINS – 4 | 2 GOLD COINS – 8 |
| 5 JOKERS – 40 | 5 JOKERS – 80 | 5 JOKERS – 160 | 5 JOKERS – 320 |

REGULAR PAYOUTS

| BET/CARD =1 | BET/CARD =2 | BET/CARD =4 | BET PER CARD =8 |
|---|---|---|---|
| HORIZONTAL SLINGO – 1 | HORIZONTAL SLINGO – 2 | HORIZONTAL SLINGO – 4 | HORIZONTAL SLINGO – 8 |
| VERTICAL SLINGO – 1 | VERTICAL SLINGO – 2 | VERTICAL SLINGO – 4 | VERTICAL SLINGO – 8 |
| DIAGONAL SLINGO – 1 | DIAGONAL SLINGO – 2 | DIAGONAL SLINGO – 4 | DIAGONAL SLINGO – 8 |
| FULL CARD – 400 | FULL CARD – 800 | FULL CARD – 1,600 | FULL CARD – 3,200 |
| LONG HORIZONTAL COVERS (10) – 5 | LONG HORIZONTAL COVERS (10) – 10 | LONG HORIZONTAL COVERS (10) – 20 | LONG HORIZONTAL COVERS (10) – 40 |
| LONG DIAGONAL COVERS (10) – 5 | LONG DIAGONAL COVERS (10) – 10 | LONG DIAGONAL COVERS (10) – 20 | LONG DIAGONAL COVERS (10) – 40 |

FIG. 11B

CARD 1

BONUS PAYOUTS

| BET PER CARD =1 | BET PER CARD =2 | BET PER CARD =4 | BET PER CARD =8 |
|---|---|---|---|
| 5 GOLD COINS – 1,000 | 5 GOLD COINS – 2,000 | 5 GOLD COINS – 4,000 | 5 GOLD COINS – 8,000 |
| 4 GOLD COINS – 60 | 4 GOLD COINS – 120 | 4 GOLD COINS – 240 | 4 GOLD COINS – 480 |
| 3 GOLD COINS – 5 | 3 GOLD COINS – 10 | 3 GOLD COINS – 20 | 3 GOLD COINS – 40 |
| 2 GOLD COINS – 1 | 2 GOLD COINS – 2 | 2 GOLD COINS – 4 | 2 GOLD COINS – 8 |
| 5 JOKERS – 40 | 5 JOKERS – 80 | 5 JOKERS – 160 | 5 JOKERS – 320 |

REGULAR PAYOUTS

| BET/CARD =3 | BET/CARD =6 | BET/CARD =9 | BET PER CARD =8 |
|---|---|---|---|
| HORIZONTAL SLINGO – 1 | HORIZONTAL SLINGO – 2 | HORIZONTAL SLINGO – 4 | HORIZONTAL SLINGO – 8 |
| VERTICAL SLINGO – 1 | VERTICAL SLINGO – 2 | VERTICAL SLINGO – 4 | VERTICAL SLINGO – 8 |
| DIAGONAL SLINGO – 1 | DIAGONAL SLINGO – 2 | DIAGONAL SLINGO – 4 | DIAGONAL SLINGO – 8 |
| FULL CARD – 400 | FULL CARD – 800 | FULL CARD – 1,600 | FULL CARD – 3,200 |

CARD 2

BONUS PAYOUTS

| BET PER CARD =1 | BET PER CARD =2 | BET PER CARD =4 | BET PER CARD =8 |
|---|---|---|---|
| 5 GOLD COINS – 1,000 | 5 GOLD COINS – 2,000 | 5 GOLD COINS – 4,000 | 5 GOLD COINS – 8,000 |
| 4 GOLD COINS – 60 | 4 GOLD COINS – 120 | 4 GOLD COINS – 240 | 4 GOLD COINS – 480 |
| 3 GOLD COINS – 5 | 3 GOLD COINS – 10 | 3 GOLD COINS – 20 | 3 GOLD COINS – 40 |
| 2 GOLD COINS – 1 | 2 GOLD COINS – 2 | 2 GOLD COINS – 4 | 2 GOLD COINS – 8 |
| 5 JOKERS – 40 | 5 JOKERS – 80 | 5 JOKERS – 160 | 5 JOKERS – 320 |

REGULAR PAYOUTS

| BET/CARD =1 | BET/CARD =2 | BET/CARD =4 | BET PER CARD =8 |
|---|---|---|---|
| HORIZONTAL SLINGO – 1 | HORIZONTAL SLINGO – 2 | HORIZONTAL SLINGO – 4 | HORIZONTAL SLINGO – 8 |
| VERTICAL SLINGO – 1 | VERTICAL SLINGO – 2 | VERTICAL SLINGO – 4 | VERTICAL SLINGO – 8 |
| DIAGONAL SLINGO – 1 | DIAGONAL SLINGO – 2 | DIAGONAL SLINGO – 4 | DIAGONAL SLINGO – 8 |
| FULL CARD – 400 | FULL CARD – 800 | FULL CARD – 1,600 | FULL CARD – 3,200 |
| LONG HORIZONTAL COVERS (10) – 10 | LONG HORIZONTAL COVERS (10) – 20 | LONG HORIZONTAL COVERS (10) – 30 | LONG HORIZONTAL COVERS (10) – 40 |

FIG. 12A

CARD 3

BONUS PAYOUTS

| BET PER CARD =1 | BET PER CARD =2 | BET PER CARD =4 | BET PER CARD =8 |
|---|---|---|---|
| 5 GOLD COINS – 1,000 | 5 GOLD COINS – 2,000 | 5 GOLD COINS – 4,000 | 5 GOLD COINS – 8,000 |
| 4 GOLD COINS – 60 | 4 GOLD COINS – 120 | 4 GOLD COINS – 240 | 4 GOLD COINS – 480 |
| 3 GOLD COINS – 5 | 3 GOLD COINS – 10 | 3 GOLD COINS – 20 | 3 GOLD COINS – 40 |
| 2 GOLD COINS – 1 | 2 GOLD COINS – 2 | 2 GOLD COINS – 4 | 2 GOLD COINS – 8 |
| 5 JOKERS – 40 | 5 JOKERS – 80 | 5 JOKERS – 160 | 5 JOKERS – 320 |

REGULAR PAYOUTS

| BET/CARD =1 | BET/CARD =2 | BET/CARD =4 | BET PER CARD =8 |
|---|---|---|---|
| HORIZONTAL SLINGO – 1 | HORIZONTAL SLINGO – 2 | HORIZONTAL SLINGO – 4 | HORIZONTAL SLINGO – 8 |
| VERTICAL SLINGO – 1 | VERTICAL SLINGO – 2 | VERTICAL SLINGO – 4 | VERTICAL SLINGO – 8 |
| DIAGONAL SLINGO – 1 | DIAGONAL SLINGO – 2 | DIAGONAL SLINGO – 4 | DIAGONAL SLINGO – 8 |
| FULL CARD – 400 | FULL CARD – 800 | FULL CARD – 1,600 | FULL CARD – 3,200 |
| LONG HORIZONTAL COVERS (10) – 10 | LONG HORIZONTAL COVERS (10) – 20 | LONG HORIZONTAL COVERS (10) – 30 | LONG HORIZONTAL COVERS (10) – 40 |
| LONG DIAGONAL COVERS (10) – 10 | LONG DIAGONAL COVERS (10) – 20 | LONG DIAGONAL COVERS (10) – 20 | LONG DIAGONAL COVERS (10) – 40 |

CARD 4

BONUS PAYOUTS

| BET PER CARD =1 | BET PER CARD =2 | BET PER CARD =4 | BET PER CARD =8 |
|---|---|---|---|
| 5 GOLD COINS – 1,000 | 5 GOLD COINS – 2,000 | 5 GOLD COINS – 4,000 | 5 GOLD COINS – 8,000 |
| 4 GOLD COINS – 60 | 4 GOLD COINS – 120 | 4 GOLD COINS – 240 | 4 GOLD COINS – 480 |
| 3 GOLD COINS – 5 | 3 GOLD COINS – 10 | 3 GOLD COINS – 20 | 3 GOLD COINS – 40 |
| 2 GOLD COINS – 1 | 2 GOLD COINS – 2 | 2 GOLD COINS – 4 | 2 GOLD COINS – 8 |
| 5 JOKERS – 40 | 5 JOKERS – 80 | 5 JOKERS – 160 | 5 JOKERS – 320 |

REGULAR PAYOUTS

| BET/CARD =1 | BET/CARD =2 | BET/CARD =4 | BET PER CARD =8 |
|---|---|---|---|
| HORIZONTAL SLINGO – 1 | HORIZONTAL SLINGO – 2 | HORIZONTAL SLINGO – 4 | HORIZONTAL SLINGO – 8 |
| VERTICAL SLINGO – 1 | VERTICAL SLINGO – 2 | VERTICAL SLINGO – 4 | VERTICAL SLINGO – 8 |
| DIAGONAL SLINGO – 1 | DIAGONAL SLINGO – 2 | DIAGONAL SLINGO – 4 | DIAGONAL SLINGO – 8 |
| FULL CARD – 400 | FULL CARD – 800 | FULL CARD – 1,600 | FULL CARD – 3,200 |
| LONG HORIZONTAL COVERS (10) – 10 | LONG HORIZONTAL COVERS (10) – 20 | LONG HORIZONTAL COVERS (10) – 30 | LONG HORIZONTAL COVERS (10) – 40 |
| LONG DIAGONAL COVERS (10) – 10 | LONG DIAGONAL COVERS (10) – 20 | LONG DIAGONAL COVERS (10) – 20 | LONG DIAGONAL COVERS (10) – 40 |

FIG. 12B

BINGO-TYPE MATCHING GAME

RELATED APPLICATION DATA

This application is a continuation-in-part of U.S. patent application Ser. No. 13/024,118, filed Feb. 9, 2011, which is a continuation-in-part of U.S. patent application Ser. No. 11/580,728, filed on Oct. 13, 2006, now U.S. Pat. No. 7,993,193, issued Aug. 9, 2011, which claims priority to U.S. Provisional Application Ser. No. 60/786,857, filed on Mar. 29, 2006, the entire contents of which are incorporated herein by reference. This non-provisional application is related to U.S. Pat. Nos. 5,935,002 and 5,647,798. The entire contents of both U.S. patents are incorporated herein by reference.

FIELD OF THE INVENTION

The present invention relates to games and gaming devices, and particularly to wagering games and devices.

BACKGROUND OF THE INVENTION

Bingo has long been a popular game and various devices for use in association with the game have been developed. Traditionally, Bingo was played using hand cards or paper Bingo sheets which were difficult to facilitate repeated use. The Bingo numbers were "cancelled" by applying a chip to the card, or using a special marker or "dauber". With the advent of electronic online interactive games and casino slot machine games, it has become more popular, efficient and entertaining to use an interactive Bingo type game over the traditional paper Bingo type game. Further, in the drive to attract greater numbers of players, casinos strive to include games that are familiar, simple to understand, engaging, and entertaining.

Traditional Bingo games, either played with paper cards or electronic card representations are limited in the manner in which the results of a game may be displayed. In order to maintain player interest in the game, it is desirable to have an option of displaying results to the players in a variety of different fashions. It is also desirable to further increase the speed at which Bingo-type games may be played and to have the ability to play a plurality of Bingo cards at the same time.

It is an object of the present disclosure to offer a broad spectrum of single, dual and multiplayer games for players of different ages and interests. Still further there is a need for a device and method which permits the player to play more than one card at a time and wager a desired amount between a pre-selected maximum and minimum amount for each game with an option to wager a desired amount per card played.

SUMMARY OF THE INVENTION

One embodiment of the invention comprises a matching or bingo-like game where a player attempts to achieve matches of base symbols to two or more sets of player symbols. In one embodiment, the player symbols are displayed in at least two matrices and the player attempts to match displayed base symbols to the player symbols displayed in the at least two matrices. As one aspect of the invention, a winning result may be declared if the player successfully matches a predetermined combination or pattern of player symbols in the at least two matrices. In a preferred embodiment, a winning result is declared for matches of all player symbols in a contiguous row, column or diagonal spanning at least two player matrices.

Embodiments of the invention also comprise devices, such as gaming machines, for presenting games of the invention. In one embodiment, a gaming device may include an input device for receiving user inputs from a player and a display for displaying game information, such as a graphic user interface (GUI) containing game information. In one embodiment, the GUI includes at least two n column by n row random number (or symbol) display matrices, a first set of n random number display regions, at least one actuation icon. The device further includes a processor, responsive to the user inputs, for executing an application program to cause the display of the GUI. The processor includes a first random number generator for generating random numbers to be displayed in at least one of the at least two n column by n row random number display matrices and a second random number generator for generating a first set of random numbers responsive to actuation of the at least one actuation icon. Each random number of the first set is displayed by a respective one of the first of the n random number display regions. Each random number of the first set of random numbers corresponds to two display matrices of the at least two n column by n row random number display matrices. The processor further includes comparing means for comparing each of the first set of random numbers with the numbers displayed by the display matrices, and, for each match, the processor automatically covers the corresponding matching numbers displayed by the display matrices; and determining means for determining whether at least one of the at least two display matrices displays a predetermined pattern of matches, such as an amount of numbers contiguously matched in a row, a predetermined amount of numbers contiguously matched in a column, a predetermined amount of numbers contiguously matched in a diagonal, or all of the numbers of the at least two display matrices have been matched, and, if so, generating a signal for indicating a winning condition.

The device includes a second set of n random number display regions and a third random number generator for generating a second set of random numbers, responsive to actuation of the at least one actuation icon. Each random number of the second set is displayed by a respective one of the second set of the n random number display region. Each random number of the second set of random numbers corresponds to two additional display matrices of the at least two n column by n row random number display matrices.

Additionally, the device includes comparing means for comparing each of the second set of random numbers with the numbers displayed by the display matrices, and, for each match, the processor automatically covers the corresponding matching number displayed by the display matrices; and determining means for determining whether at least one of the at least two additional display matrices displays a predetermined amount of numbers contiguously matched in a row, a predetermined amount of numbers contiguously matched in a column, a predetermined amount of numbers contiguously matched in a diagonal, or all of the numbers of the at least two additional display matrices have been matched, and, if so, generating a signal for indicating a winning condition.

A random number of the first set of n random number display regions can match a random number in any column of the respective at least two n column by n row random number display matrices. The first set of n random numbers includes random numbers within a predetermined range and without repetition within the first set.

A random number of the second set of n random number display regions can match a random number in any column of the respective at least two additional n column by n row random number display matrices. The second set of n random numbers includes random numbers within a predetermined range and without repetition within the second set.

In one embodiment, the first, second and third random number generators generate at least one random number selected from the group consisting of: a first set of random numbers ranging from 1 to 15; a second set of random numbers ranging from 16 to 30; a third set of random numbers ranging from 31 to 45; a fourth set of random numbers ranging from 46 to 60; and a fifth set of random numbers ranging from 61 to 75.

The second and third random number generators can randomly select symbols selected from the group consisting of a symbol which awards the player a predetermined number of points; a symbol which causes a number displayed by a display matrix of the at least two display matrices to be covered; a symbol which awards the player a free spin; and a symbol which enables the player to play a bonus round.

The device further includes means for receiving a bet from the player prior to actuation of the at least one actuation icon, and means for awarding a progressive jackpot to the player upon display by the first and second set of n random number display regions of a predetermined symbol and based on the player having placed a bet greater than a predetermined number and having selected at least four display matrices of the at least two display matrices. The means for awarding the progressive jackpot can include awarding credits equal to the amount of the progressive jackpot to the player by storing the credits on a card having a magnetic stripe and inserted within the device as known in the art.

Another embodiment of the invention comprises a multi-player game. Each player is assigned at least one set of player symbols, such as a set of player symbols in a matrix, and each player attempts to obtain matches of base symbols to their player symbols. Preferably, winning results are declared if combinations of matches of player symbols are achieved which span the matrices of two or more players. In one embodiment, a winning result may be declared for matches of player symbols along a contiguous row extending through two adjacent matrices belonging to two different players. Other winning combinations may include matches of player symbols along two, three or four contiguous rows, columns or diagonals through adjacent player matrices.

In a multi-player environment, different players may play different gaming devices. Game information may be displayed on the devices or on associated equipment, such as one or more common displays.

In other embodiments of the invention, instead of utilizing one or more random symbol or number generators to generate the base symbols or numbers, the base symbols or numbers might be called, such as via selection of one or more balls, or might be generated in other manners. The base symbols or numbers may be called or selected apart from user activation. In addition, instead of displaying individual sets of base symbols or numbers corresponding to each display matrix, base symbols may be displayed for matching to the symbols or numbers of two or more display matrixes. For example, a single set of base symbols may be displayed for matching against the symbols or numbers of two or more display matrices corresponding to a single player or more than one player.

The games of the invention may be presented as base games or bonus events to other games.

BRIEF DESCRIPTION OF THE DRAWINGS

The features of the disclosed device and methods will become more readily apparent and may be better understood by referring to the following detailed description of illustrative embodiments of the present disclosure, taken in conjunction with the accompanying drawings, where:

FIGS. 10A and 10B are tables showing regular and bonus round payouts for each of four cards in accordance with one embodiment of the invention;

FIGS. 11A and 11B are tables showing regular and bonus round payouts for each of four cards in accordance with another embodiment of the invention;

FIG. 12A and 12B are tables showing regular and bonus round payouts for each of four cards in accordance with yet another embodiment of the invention;

DETAILED DESCRIPTION OF THE INVENTION

Figure 1:
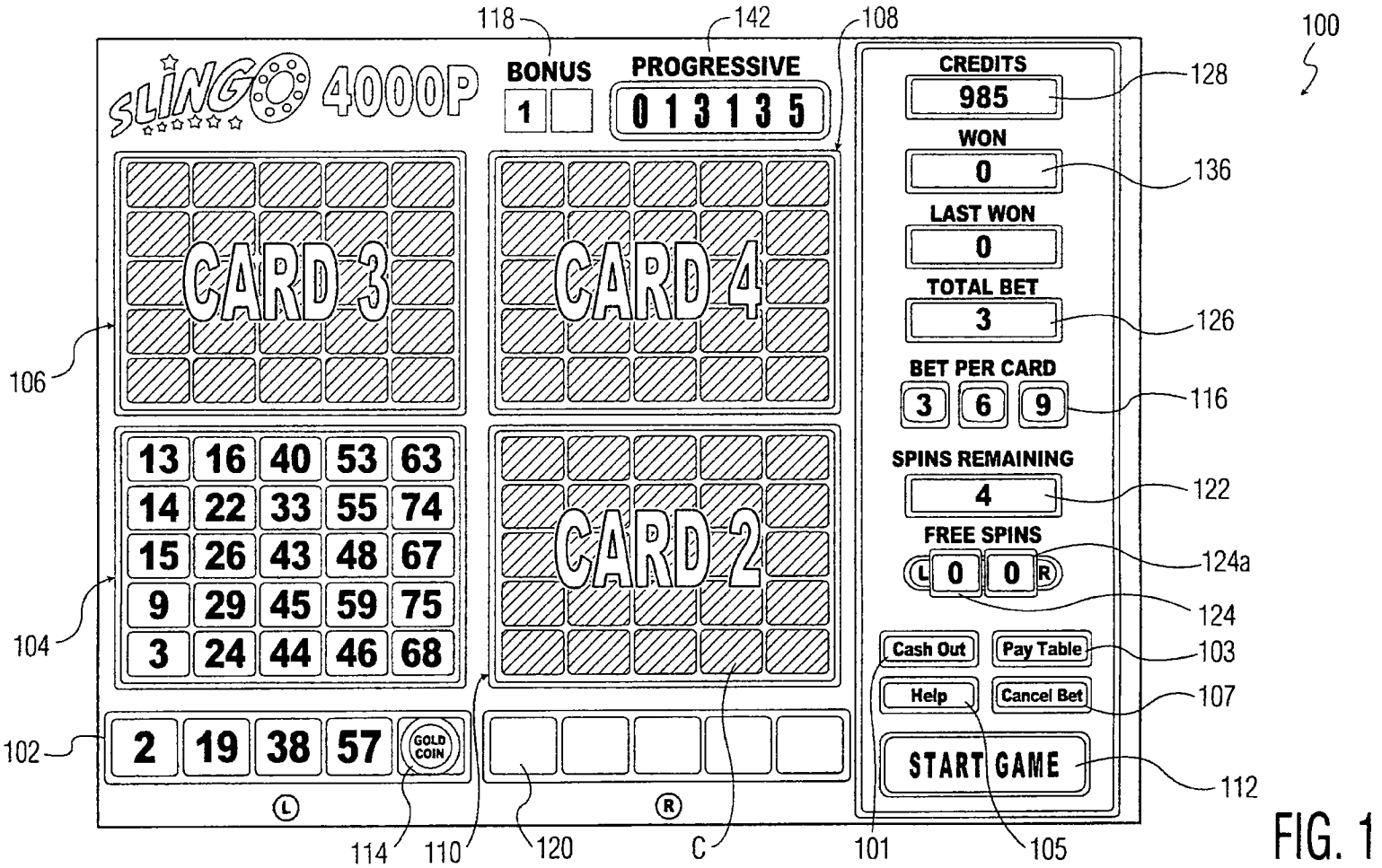
FIGS. 1-7 illustrate display screens of embodiments in accordance with the present disclosure.

Referring now in specific detail to the drawings, with like reference numerals identifying similar or identical elements, one embodiment of the invention will be described with reference to FIG. 1. FIG. 1 illustrates a graphical user interface of a display screen for playing one embodiment of a matching or Bingo-like game according to the present disclosure.

As detailed herein, the game methods of the invention can be implemented via a computing device, such as a slot machine, and a stand-alone video game console, and as a computer-readable medium for downloading the game to a computing device, such as a slot machine, television set top box, video game console, cell phone, PDA, personal computer, etc. Hence, the display screens shown by the various figures are display screens as viewed by a player looking at a personal computer monitor, LCD display of a PDA, television screen, etc.

As shown by FIGS. 1-13, the display depicts a graphic user interface (GUI) 100 which includes display matrices 104, 106, 108 and 110 each having n rows and n column or n×n blocks or cells (though in other embodiments, the matrices may have other configurations, such as n×m where n and m are unequal). In the embodiment described herein n is 5 and there are 25 blocks or cells "C" for each matrix as is customary in a traditional Bingo game card (though n could be other numbers, such as 2 or 4 or 10, as examples). As will become readily apparent to those skilled in the art, each cell C of the display matrices 104, 106, 108 and 110 can be a television or LCD screen, or each display matrix can be a single television or LCD screen, or the entire GUI can be displayed by a single display screen, such as a display screen of a television, personal computer, PDA, slot machine, cell phone, etc.

The user or player has the option of choosing to play any one or all of display matrices 104, 106, 108 and/or 110. For example, the player can choose to play one, two, three, or four (or more, depending on the implementation of the game) 5×5 display matrices during a series of game plays. The user or player chooses which display matrices 104, 106, 108 and/or 110, he/she wants to play for the series of game plays by touching the GUI (touch screen GUI) or by other means, such as pushing buttons 2002, 2004, 2006, 2008 (see FIG. 13) corresponding to the display matrices 104, 106, 108 and 110.

In one embodiment, the device according to the present disclosure includes a processor, responsive to a user input via an actuation icon 112 labeled "START GAME", for executing an application program to cause a first random number generator of the processor to generate five sets of random numbers for each matrix chosen by the player. The five sets of random numbers are displayed by the five columns of each matrix chosen by the player. The five sets of random numbers are generated such that each set of random numbers is generated without repetition within the respective set and the other four sets.

As indicated herein, player or game indicia are displayed in the cells C. Such indicia or symbols may have various forms, including letters, numbers, pictures, dots or the like). In one embodiment, the symbols comprise numbers. The numbers range for each set of random numbers generated by the first random number generator is 1 to 75. Each set, however, is limited to a range within the range of 1 to 75. For example, of the five blocks or cells C corresponding to the leftmost column of the display matrices 104, 106, 108, and 110, the limited range is 1 to 15. The limited range for the second leftmost column of blocks or cells C of the display matrices 104, 106, 108, and 110 is 16 to 30. The limited range for the center column of blocks or cells C of the display matrices 104, 106, 108, and 110 is 31 through 45. The limited range for the second rightmost column of blocks or cells C of the display matrices 104, 106, 108, and 110 is 46 through 60. The limited range for the rightmost column of blocks or cells C of the display matrices 104, 106, 108, and 110 is 61 through 75. As in the game of Bingo, the first random number generator is designed such that a number is not displayed more than once by the display matrices 104, 106, 108 and 110 which are analogous to Bingo game cards.

The processor further includes a second random number (or symbols/indicia) generator, responsive to a user input, such as actuation or selection of the actuation icon 112, for generating at least one set of random numbers for display by the n display regions 102 and/or 120. As shown by the figures, the exemplary embodiment described herein has n equal to five.

The processor further includes a comparator, such as a comparator module having programmable instructions executable by the processor for comparing the at least one set of random numbers displayed by the n display regions 102 and/or 120 with the numbers displayed in the corresponding columns of the display matrices 104, 106, 108 and 110, and, if there is a match, allowing the processor to automatically cover the matching number in the display matrices 104, 106, 108 and 110 to indicate a match. In some embodiments, a player could be required to "daub" or indicate matches in order to claim them, rather than having such accomplished automatically by the gaming device.

More particularly, each block or cell C of the display regions 102 and 120 corresponds to a respective column of two of the display matrices 104, 106, 108 and 110. The leftmost display region of display regions 102 corresponds to the leftmost column of the display matrices 104 and 106. The second leftmost display region of display regions 102 corresponds to the second leftmost column of the display matrices 104 and 106. The center display region of the display regions 102 corresponds to the center column of the display matrices 104 and 106. The second rightmost display region of the display regions 102 corresponds to the second rightmost column of the display matrices 104 and 106. The rightmost display region of the display regions 102 corresponds to the rightmost column of the display matrices 104 and 106.

Similarly, the leftmost display region of display regions 120 corresponds to the leftmost column of the display matrices 108 and 110. The second leftmost display region of display regions 120 corresponds to the second leftmost column of the display matrices 108 and 110. The center display region of the display regions 120 corresponds to the center column of the display matrices 108 and 110. The second rightmost display region of the display regions 120 corresponds to the second rightmost column of the display matrices 108 and 110. The rightmost display region of the display regions 120 corresponds to the rightmost column of the display matrices 108 and 110.

The processor further includes determining means, such as a determining module having programmable instructions executable by the processor for determining whether the display matrices 104, 106, 108 and 110 has a predetermined amount of numbers matched in a matrix—i.e. a winning pattern of matches. In one embodiment, a winning pattern of matches comprises (but is not limited to) a predetermined amount of numbers contiguously matched in a row of one matrix, a predetermined amount of numbers contiguously matched in a column of one matrix, and/or a predetermined amount of numbers contiguously matched in a diagonal of one matrix. In one embodiment, the determining means also determines when the player has selected to play two or more matrices 104, 106, 108 and 110, whether there are a predetermined amount of numbers contiguously matched in a row spanning two matrices, a predetermined amount of numbers contiguously matched in a column spanning two matrices, and/or a predetermined amount of numbers contiguously matched in a diagonal spanning two matrices. The determining means preferably also determines whether all of the numbers of one or more matrices being played have been matched. Of course, the determining means might be configured to determine if other combinations or patterns of matches have been achieved relative to one or more of the matrices. If one or more of the above conditions are determined to have occurred by the determining means, the processor generates a win or Bingo indication signal for indicating a win or Bingo condition to the player. The Bingo indication signal can include an audiovisual indication signal, an audio indication signal or a visual indication signal for alerting the player of the Bingo condition, and/or the one or more rows and/or columns which caused the Bingo condition. In the embodiment shown by the figures, the predetermined number for obtaining a Bingo condition in one matrix is five, and the predetermined number for obtaining a Bingo condition by matching numbers spanning a row, a column and/or a diagonal of two matrices is ten.

The first and second random number generators are preferably comprised of a set of programmable instructions executable by the processor.

Figure 2:
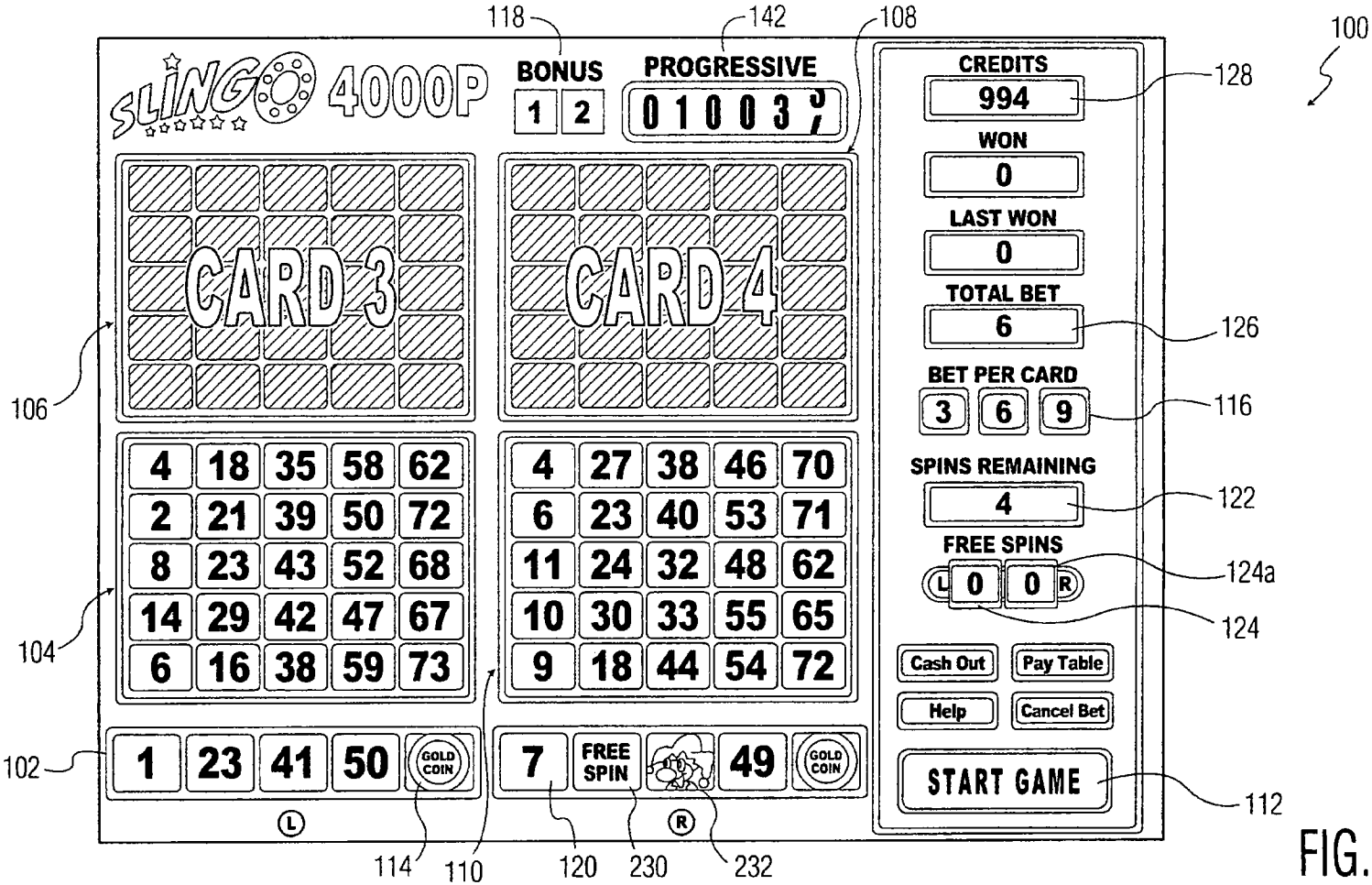
Figure 6:
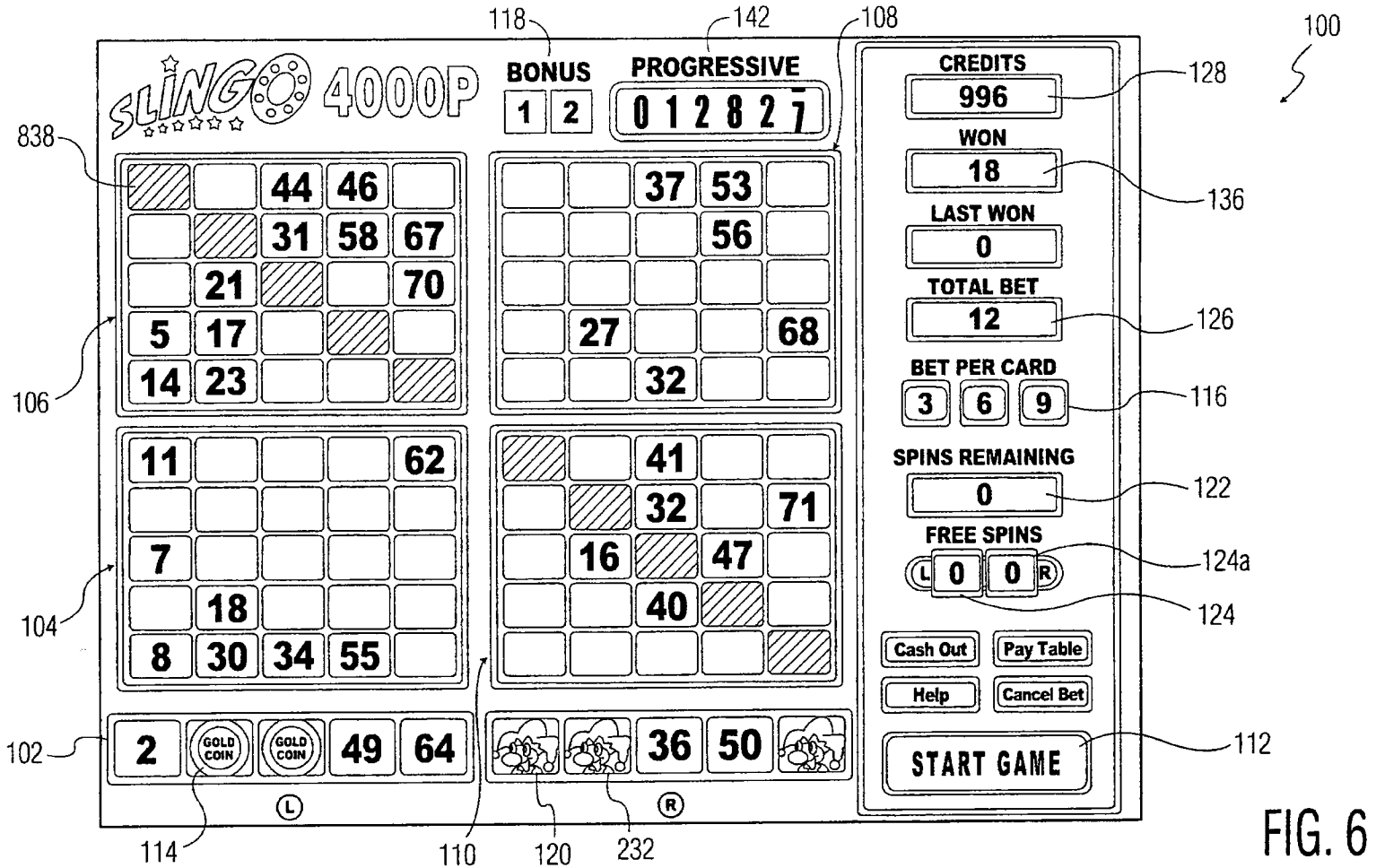

It has been found that a Bingo game played on a gaming machine in this and similar embodiments can be enhanced when the random number display regions include special symbols in addition to the random numbers. Examples of special symbols which have been found to enhance the game include a "Free Spin" symbol 230 as shown in FIG. 2, which allows the player an extra spin if displayed, and a "Joker" symbol 232 which causes the processor to automatically select and cover any uncovered block within a column corresponding to the display region displaying the "Joker" symbol. Alternatively, the "Joker" symbol 232 causes the processor to automatically select and cover any uncovered block of the matrices corresponding to the n display regions which has the display region displaying the "Joker" symbol. Also shown by FIG. 2 is a "Gold Coin" symbol 114. The player is awarded additional credits if at least two "Gold coin" symbols 114 are displayed as shown by FIG. 6 and illustrated by the payout tables shown by FIGS. 10-12. Alternatively, the player can be awarded additional credits if at least one "Gold coin" symbol 114 is displayed as shown by FIG. 2.

Exemplary plays of a preferred embodiment are now described in detail with reference to FIGS. 1-7 showing non-sequential display screens from different series of game plays. Each game play includes five plays. It is contemplated that a game play can include more than five plays due to free spins accumulated during the five plays (each spin comprising the random display of a set of base numbers and comparison of those numbers to the player numbers in the one or more corresponding matrices).

As described above, the GUI 100 is configured with actuation icon 112 for starting the game after placing a bet and selecting which matrices to play. The GUI 100 further includes two sets of five random number display regions 102, 120. Each display region of the display regions 102 corresponds to a column of display matrices 104 and 106; each display region of the display regions 120 corresponds to a column of display matrices 108 and 110.

With reference to the figures, the GUI 100 also includes "Free Spin" displays 124 and 124*a* which indicate the cumulative total number of free spin symbols 230 displayed by random number display regions 102 and 120, respectively, during the series of game plays. The available free spins as displayed by display 124 can only be played using matrices 104 and 106, and the available free spins as displayed by display 124*a* can only be played using matrices 108 and 110.

Figure 3:
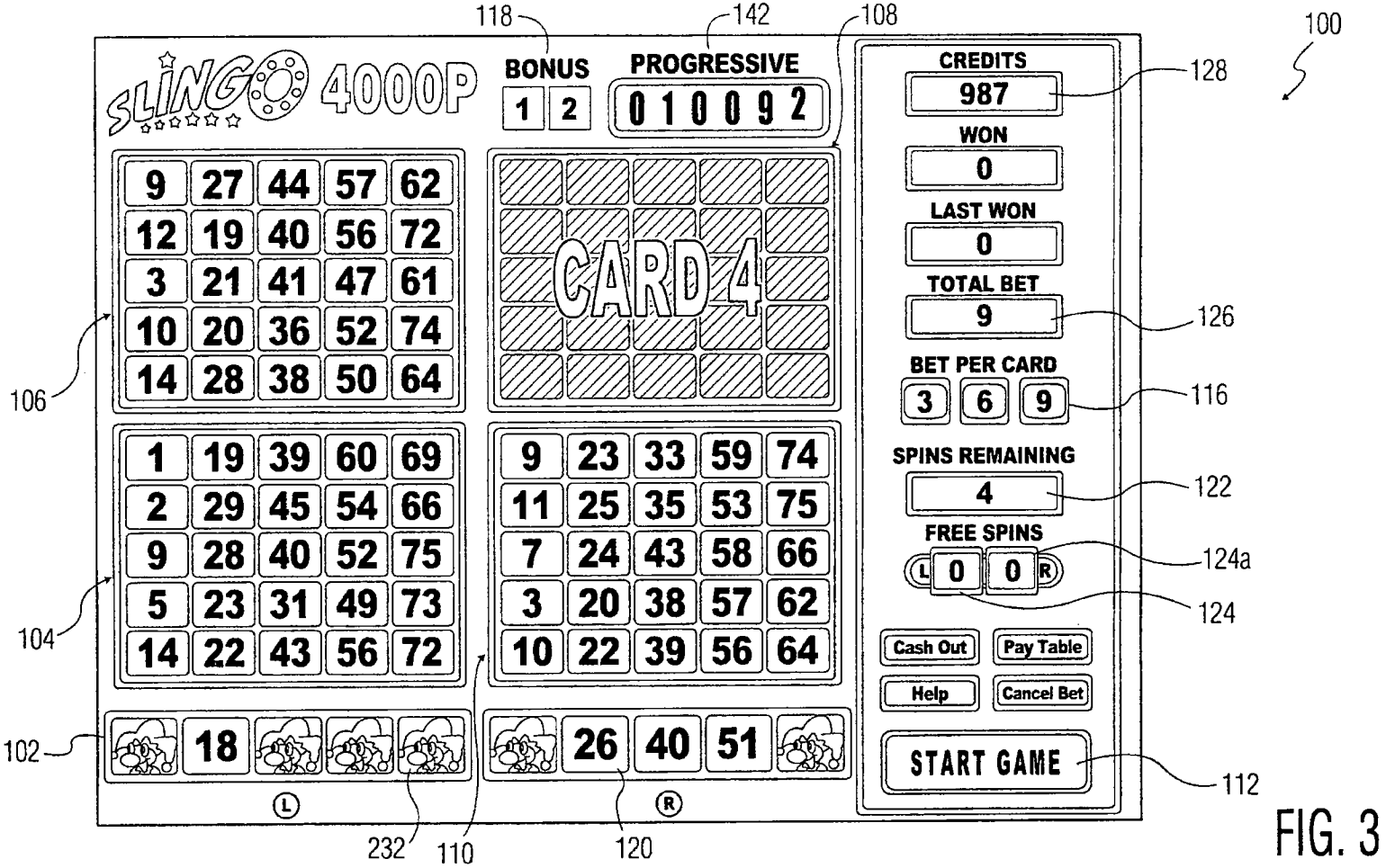

"Bet Per Card" display 116 indicates different credits the user can bet, i.e., in the embodiment illustrated such may comprise either 3, 6 or 9 credits, per matrix or "card" selected to be played (though in other embodiments, other amounts of credits might be wagered). "Total Bet" display 126 indicates the cumulative bet for all matrices 104, 106, 108 and 110. FIG. 1 indicates that the player has bet 3 credits for display matrix 104 which was selected to be played; FIG. 2 indicates that the player has bet 3 credits for each display matrix 104 and 110 which was selected to be played for a total of 6 credits; FIG. 3 indicates that the player has bet 3 credits for each display matrix 104, 106 and 110 which was selected to be played for a total of 9 credits; and FIG. 4 indicates that the player has bet 3 credits for each display matrix 104, 106, 108 and 110 which was selected to be played for a total of 12 credits.

"Credits" display 128 indicates the amount of credits the player has and the "Won" display 136 indicates the amount of credits won by the player during the series of game plays or spins. "Spins Remaining" display 122 indicates the number of game plays or spins remaining. In the preferred embodiment, there is a minimum of five spins or game plays per game. That is, there are five game spins and the player can be awarded an infinite number of free spins. In other embodiments, the game may permit or include other numbers of spins (including greater or lesser numbers of spins).

Figure 7:
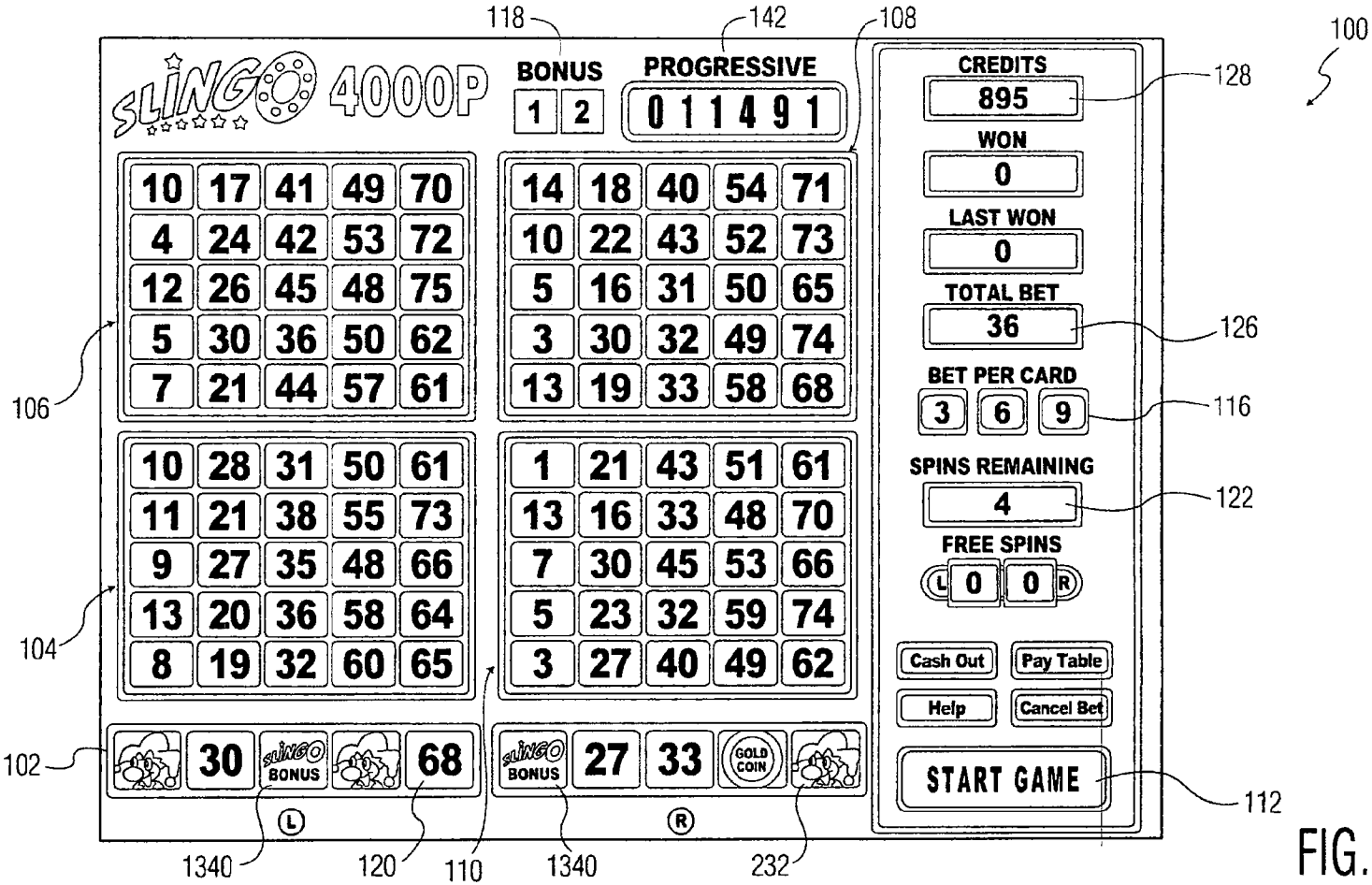

Bonus" display 118 indicates whether the user has obtained at least one bonus round play. One embodiment of a bonus round play is described below with reference to FIGS. 8 and 9. When display matrices 104 and/or 106 are played and bonus symbol 1340 (shown in FIG. 7) appears in one of the random number display regions of 102, "Bonus" display 118 indicates a 1. "Bonus" display 118 indicates a 2 in the right box (as shown in FIG. 7) if display matrices 108 and/or 110 are played and a bonus symbol appears in one of the random number display regions 120. If the player places a maximum "Total Bet" 126 of 9, selects all four matrices 104, 106, 108 and 110 to be played, and a bonus symbol appears in both random number display regions 102 and 120, the "Bonus" display indicates a 1 in the left box and a 2 in the right box and the "Progressive" jackpot as indicated by the "Progressive" display jackpot 142 is awarded to the player. The progressive jackpot is awarded to the player by methods known in the art, such as storing credits equal to the amount of the progressive jackpot on a card having a magnetic stripe and inserted within the device.

Figure 13:
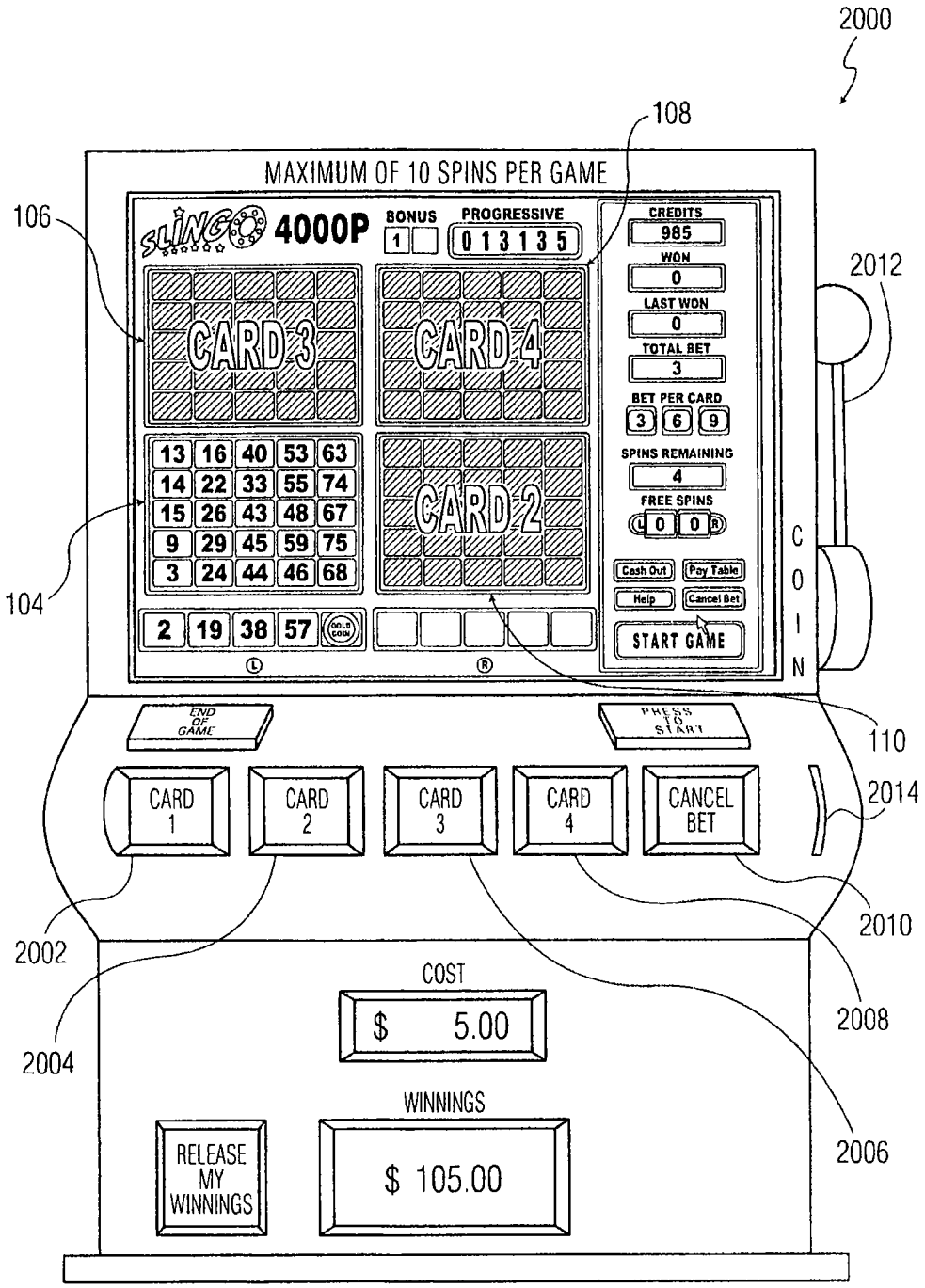
FIG. 13 is a front view of a computing device for playing the game in accordance with the present disclosure.

Other displays on the GUI 100 include a "Cash Out" display 101 which cashes out your winnings, a "Pay Table" display 103 which shows a pay table layout with respect to the amount bet per display matrix 104, 106, 108 and 110 (as shown in FIGS. 10-12), a "Help" display 105 for instructions and a "Cancel Bet" display 107 for cancelling the bet placed. The "Cancel Bet" display can also be provided as a button 2010 on a computing device 2000 as shown by FIG. 13.

FIG. 2 is a display screen of a particular, individual game play of the game according to the present disclosure. The player has selected to play display matrices 104 and 110. The user has a "Total Bet" 126 of three credits per display matrix and has four remaining spins or game plays as shown by display 122. During the game play, a "Gold coin" symbol 114 is randomly selected and displayed by one of the displays of display regions 102 and one of the displays of display regions 120. Since only one "Gold coin" symbol 114 is displayed by each display region 102 and 120, the player is not awarded any credits. As stated above, in the embodiment shown by the figures, there must be a minimum of two "Gold coin" symbols 114 displayed by a display region for the player to be awarded credits.

Further, during the game play as shown by FIG. 2, a "Free Spin" symbol 230 is displayed by one of the displays of display regions 120 and subsequently the "Free Spins" display 124*a* displays one free spin. During game play, a "Joker" symbol 232 is displayed by one of the displays of display regions 120. The "Joker" symbol 232 causes the processor to randomly select and cover a number displayed by a block of the center column of display matrix 110. The covered block will be displayed in a subsequent display screen following the display screen shown by FIG. 2. If covering a particular block will create a Bingo, the processor selects and covers that particular block.

FIG. 3 is a display screen of a particular, individual game play of the game according to the present disclosure. The player has selected to play display matrices 104, 106 and 110. The user has a "Total Bet" 126 of nine credits (3 credits per display matrix) and has four remaining spins or game plays as shown by display 122. During this individual game play, a "Joker" symbol 232 is randomly selected and displayed by four of the displays of display regions 102 and two of the displays of display regions 120. The player is hence awarded credits which are added to the previously awarded credits and the total number of credits is displayed by "Credits" display 128.

The "Joker" symbols 232 cause the processor to randomly select and cover a number displayed by a block of the leftmost, center, second rightmost and rightmost columns of display matrices 104 and 106. The "Joker" symbols 232 displayed by display regions 120 cause the processor to randomly select and cover a number in the leftmost and rightmost columns of matrix 110. The covered blocks will be displayed in a subsequent display screen following the display screen shown by FIG. 3.

Figure 4:
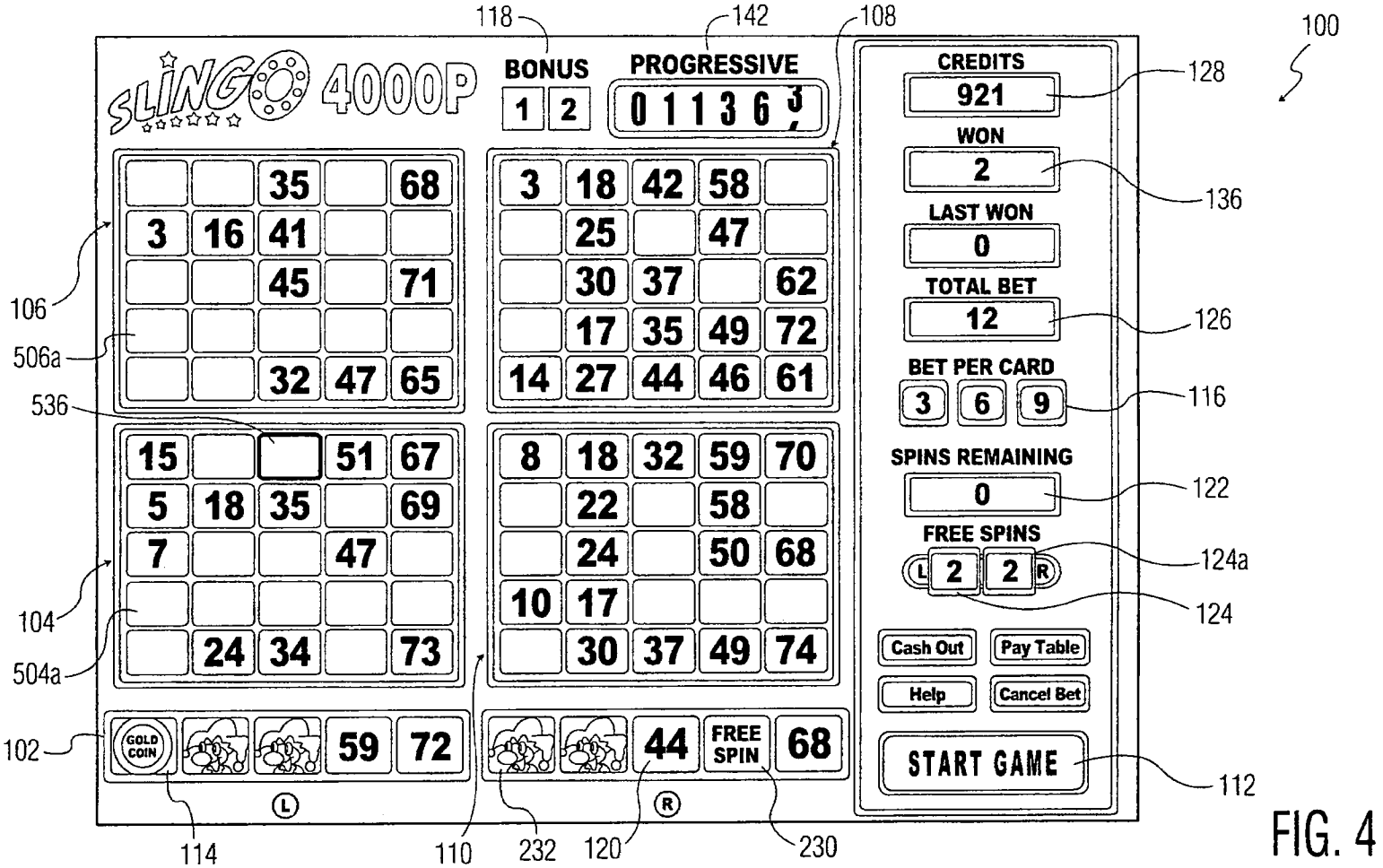

FIG. 4 is a display screen of a particular, individual game play of the game according to the present disclosure. The player has selected to play all the display matrices 104, 106, 108 and 110. The user has a "Total Bet" 126 of three credits per display matrix and has zero remaining spins or game plays as shown by display 122.

Further, during the game play as shown by FIG. 4, a "Free Spin" symbol 230 is displayed by one of the displays of display regions 120 and subsequently the "Free Spins" display 124*a* would displays three free spins. During game play, "Joker" symbols 232 are also displayed by two of the displays of display regions 102 and two of the displays of display regions 120. The "Joker" symbols 232 cause the processor to randomly select and cover a number displayed by a block of the second leftmost and center columns of display matrix 102 and 106, and to randomly select and cover a number displayed by a block of the leftmost and second leftmost columns of display matrices 108 and 110. The covered blocks will be displayed in a subsequent display screen following the display screen shown by FIG. 4. If covering particular blocks will create a Bingo, the processor selects and covers those particular blocks.

As shown by FIG. 4, the player has achieved two winning or Bingo conditions; one in each of matrices 104 and 106. The two winning or Bingo conditions are shown in display matrices 104 and 106 where five numbers were contiguously matched in rows 504*a* and 506*a*, respectively. Such an outcome or condition may be referred to as a "Slingo." In a preferred embodiment, a winning or Bingo condition is achieved when five numbers in a row, five numbers in a column or five numbers in a diagonal are contiguously matched during one game play or over a series of game plays of the game in display matrices 104, 106, 108 and 110. Such an outcome may be referred to as a "big Slingo."

Figure 5:
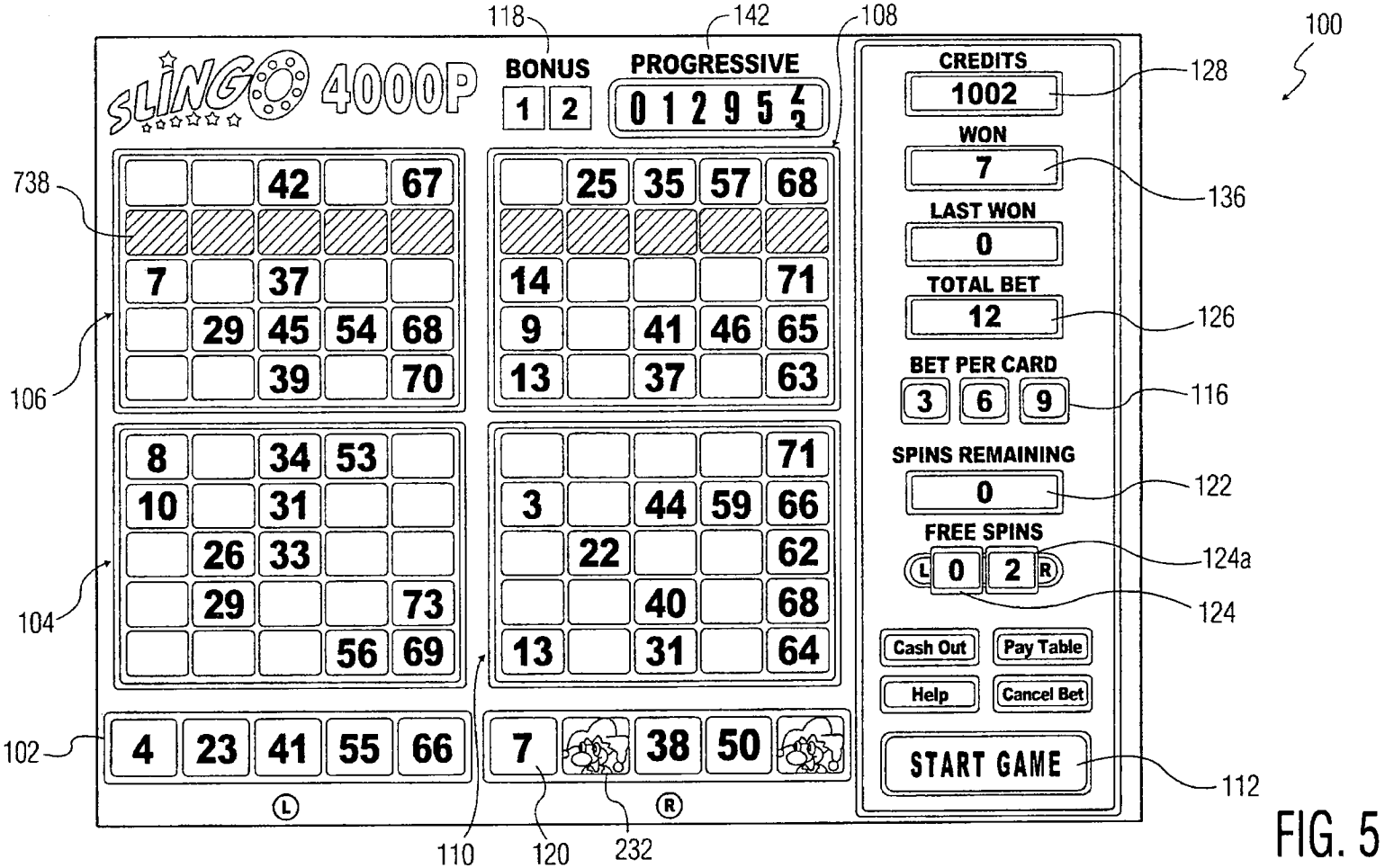

In FIG. 5, a "big Slingo" or super Bingo condition is shown where ten numbers are contiguously matched in a row 738 spanning two matrices 106 and 108. As indicated herein, a "big Slingo" is achieved when ten numbers in a row, column or diagonal spanning two display matrices are contiguously matched. Additional credits are awarded to the player for achieving a "big Slingo" and these credits are added to the previously awarded credits and the total number of credits is displayed by the "Credits" display 128. In alternate embodiments, a player can be awarded credits for contiguously matching numbers spanning two display matrices, where the amount of numbers matched is less than ten numbers, such as five numbers, where two numbers are matched in one matrix and three numbers are matched in the other matrix.

In FIG. 6, a "big Slingo" is shown where ten numbers are contiguously matched in a diagonal 838 spanning two matrices 106 and 110.

Figure 8:
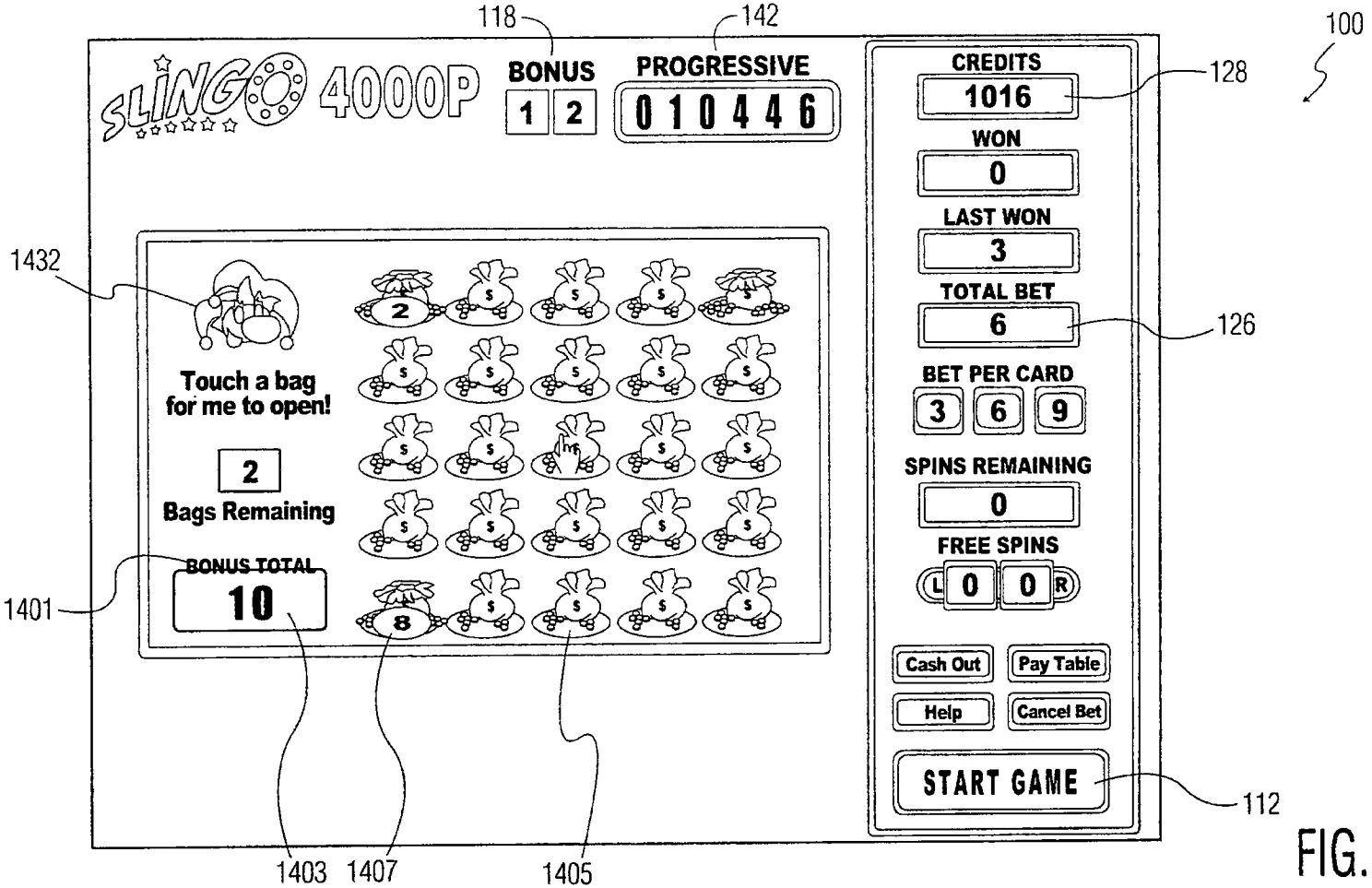
FIGS. 8-9 illustrate bonus round display screens in accordance with the present disclosure.
Figure 9:
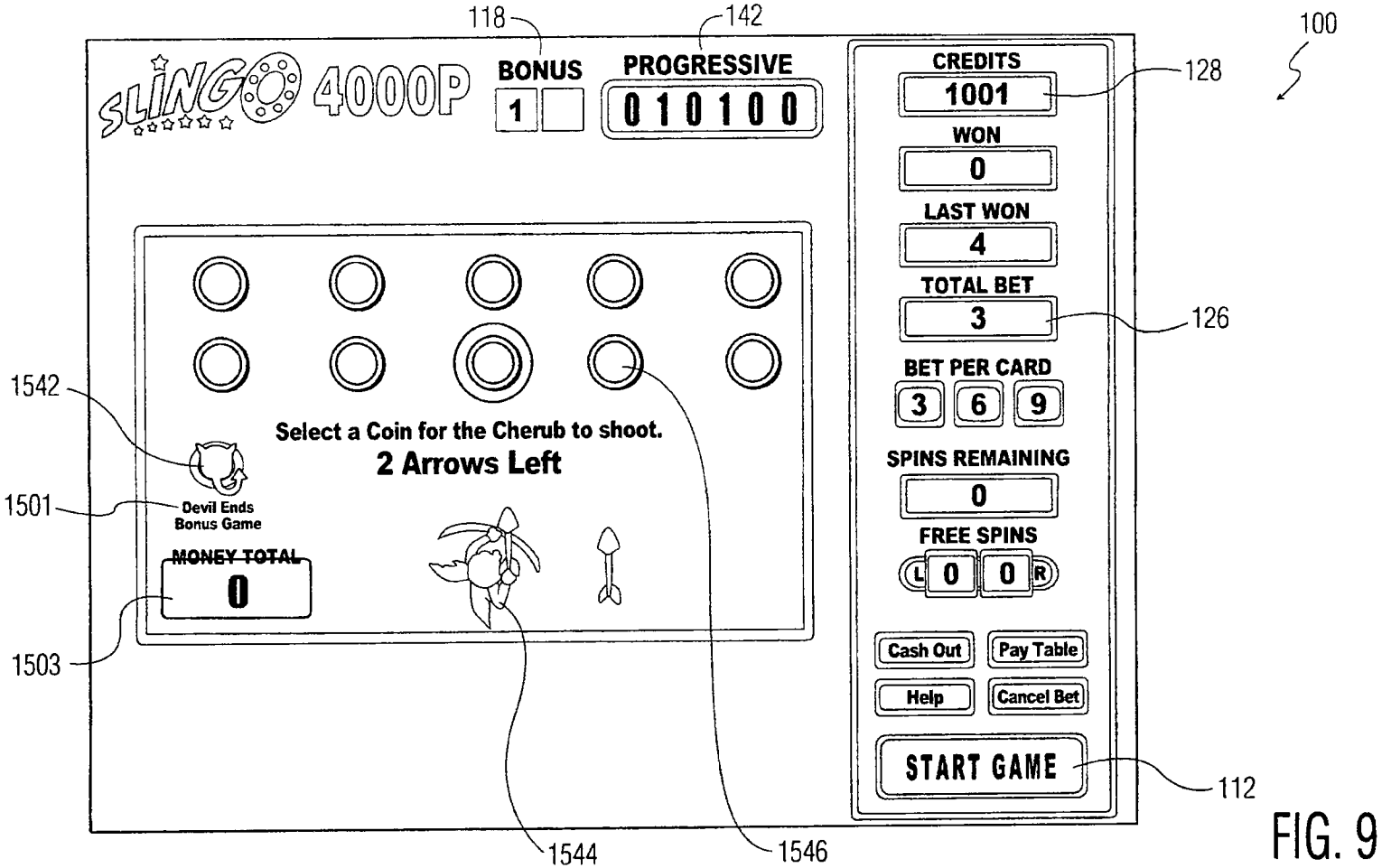

A description will now be provided regarding qualifying for a bonus round and playing a bonus round game with reference to FIGS. 7-9. It is contemplated that other bonus games can be implemented for the game according to the present disclosure besides the two bonus round games described herein.

In FIG. 7, a bonus symbol 1340 ("Slingo bonus") and another bonus symbol 1340 are displayed in random number display regions 102 and 120. The occurrence of two bonus symbols being displayed in one of the display regions 102 and in one of the display regions 120 trigger the awarding of the progressive jackpot to the player if the other two conditions described above are also met. The occurrence of bonus symbols having been displayed by the display regions 102 and 120 during the series of game plays is indicated by "Bonus" display 118. The bonus round game is triggered if only one bonus symbol 1340 is displayed during the series of game plays by one of the display regions 102 and 120.

FIG. 8 shows a bonus round display screen 1401 of GUI 100. The user touches one of five bags of gold 1405 and "Joker" symbol 1432 opens each selected bag to reveal coins 1407 won or a "devil" symbol (not shown). If a devil is revealed, turn is lost. The user keeps selecting bags until all five bags of gold 1405 have been selected. A final bonus payout is accumulated and displayed by the "Bonus Total" display 1403 in which payouts are cumulative and multiplied by the bet per display matrix previously bet by the player during the series of game plays.

FIG. 9 shows another bonus round game having bonus round display screen 1501 of GUI 100. Cherub 1544 is randomly allocated one to five arrows. Ten coins 1546 are displayed and the cherub shoots an arrow at selected coins 1546 and reveals either bonus values of 4, 6, 10, 14, 20, 30, and 50, or a devil symbol 1542 which ends the bonus round play. A final bonus payout is accumulated and displayed by the "Bonus Total" display 1503 in which payouts are cumulative and multiplied by the bet per display matrix previously bet by the player during the series of game plays.

FIGS. 10A and 10B illustrate one example of payout tables for the Bingo-like game and the bonus round game for the game according to the present disclosure, FIGS. 11A and 11B illustrate another example of payout tables, and FIGS. 12A and 12B illustrate yet another example of payout tables.

As described above, the object of the game is to be awarded credits by revealing "Gold coin" and "Joker" symbols, as well as achieving Bingo and "big Slingo" conditions by matching and covering numbers on the display matrices with a minimum of 5 game spins and any free spins obtained.

In one embodiment, there exist 64 possible winning Bingo and "big Slingo" combinations or outcomes. These are covering a complete row of five blocks (five combinations) of a matrix, covering a complete column of five blocks (five combinations) of a matrix, covering a diagonal line of five blocks in either direction (two combinations) of a matrix, covering a complete row of ten blocks (ten combinations) spanning two matrices, covering a diagonal line of ten blocks in either direction (two combinations) spanning two matrices, and completely covering an individual matrix (four possibilities). It is envisioned that one or more of the above winning outcomes can be removed as a winning outcome. Credits are also awarded for winning the progressive jackpot. The credits can be redeemed for prizes, cash, or points, such as frequent flyer mileage points, etc. It is also envisioned that other winning combinations can be added to the above winning combinations, such as covering a complete column of ten blocks spanning two matrices.

In a preferred embodiment, the game is played as a wagering game in which a player wagers monies or credits having associated monetary value. In such embodiments, as indicated, winnings may be paid for winning outcome(s), which winnings comprise monies or credits having associated monetary value. In other embodiments, however, the game may be played for points or other prizes.

The disclosed device may also be configured as a slot machine 2000 having an activating arm 2012 and a coin slot 2014 for receiving bets from a player as typically found in a slot machine as shown in FIG. 13. The display regions 102 can also be configured as wheels which spin upon activation of the activating arm. Further, the input devices may be trackballs or other pointing and GUI devices, and the selectable display regions may include LED or LCD displays, which may be fixed in a housing or mounted on the spinning wheels of a slot machine.

The game can be implemented as a set of programmable instructions and game resources (graphics, audio, video, alphanumeric text, etc.) capable of being executed by a general purpose processor or a hard-wired special-purpose processor of a computer system, hand-held computing device, or other computing device, machine or apparatus for playing the game. The set of programmable instructions and game resources can be stored on a computer-readable medium, including optical, magnetic and opto-magnetic media.

In additional embodiments, a plurality of input devices is provided to the device for enabling multiple players to play the game simultaneously. The device receives user inputs from a plurality of players playing the Bingo-like game via the plurality of input devices. In other embodiments, multiple gaming devices might be linked, thus permitting the multiple players to play games of the invention in a multi-player format. As also described herein, games of the invention may be implemented as base games or bonus events/secondary games.

As one aspect of the invention, two or more players may play different games or different gaming machines, but one or more winning results are defined by outcomes which span or include at least two different player's games and where the players sharing in the winning combination also share in awards for the winning outcome.

Figure 14:
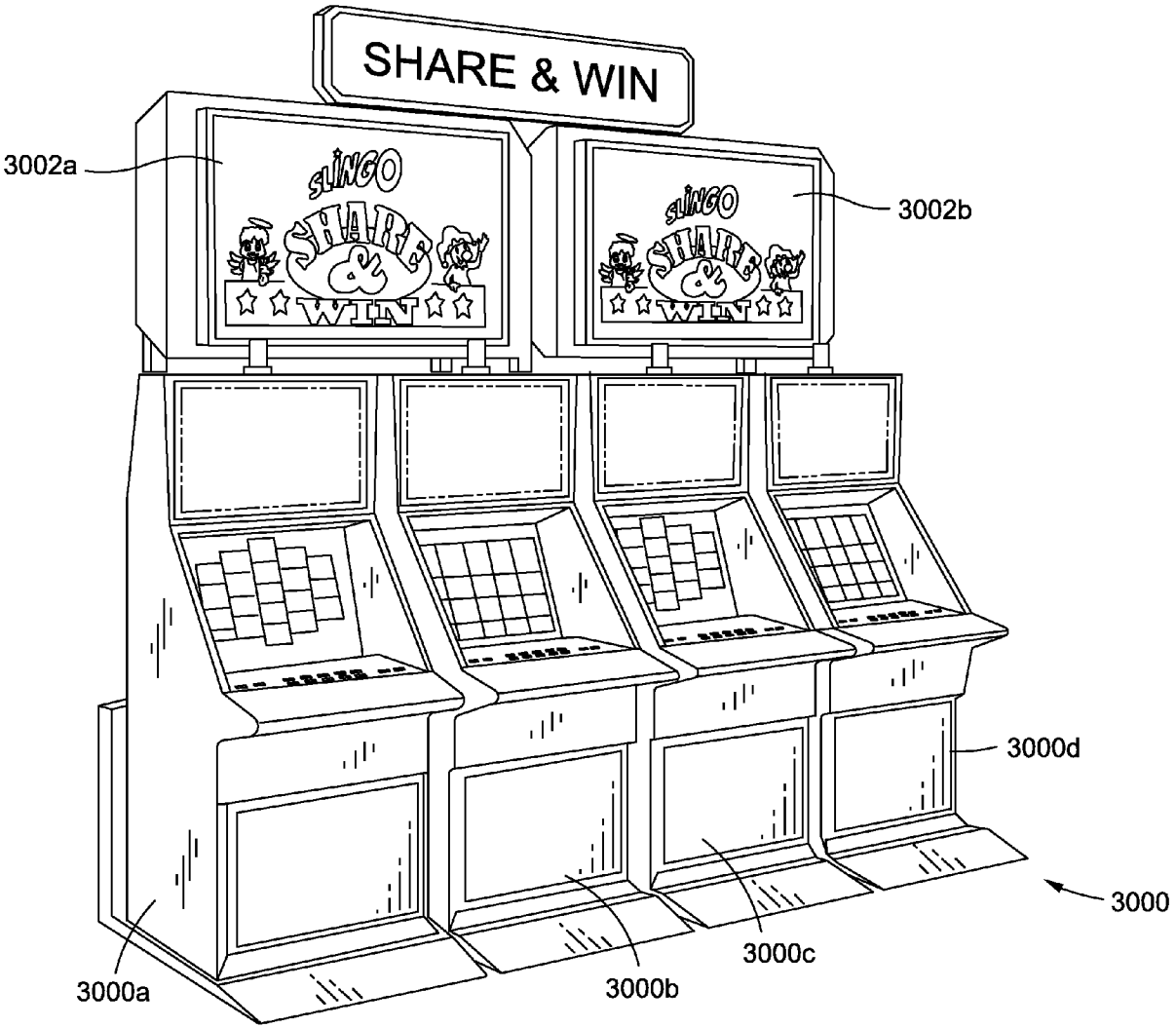
FIG. 14 illustrate a plurality of gaming devices and associated displays for presenting a multi-player game in accordance with the invention.

Another embodiment of the invention will be described with reference to FIGS. 14 and 15A-K. As illustrated in FIG. 14, a plurality of gaming devices 3000 may be provided for play by different players (though it is possible for one player to play more than one of the devices at the same time). As illustrated, four such gaming devices 3000*a-d* are provided, though there might be as few as one such device (wherein multiple players might play the same device) or more than four. In this embodiment, a game of the invention is implemented as a bonus game or secondary event. As such, each of the gaming devices 3000*a-d* is configured to present one or more base games. Such games might comprise, for example, video or reel slot games, video poker games, bingo or bingo-type games, keno games or other games now known or later developed. The base games presented at each of the gaming devices 3000*a-d* might be the same or they might be different.

At one or more times, a bonus event of the invention may be implemented. Such a bonus event might be triggered by a specific outcome or event at one or more of the gaming devices 3000*a-d* (such as receipt of a particular symbol, a particular winning or losing outcome, etc.), or otherwise, such as randomly, based upon a number of games played at the gaming devices 3000*a-d*, amounts wagered at the devices or other criteria. Preferably, information regarding the bonus event is displayed on one or more bonus displays, such as the two bonus displays 3002*a,b* illustrated in FIG. 14. Of course, bonus event information might be displayed on one or more displays of the main gaming devices 3000*a-d* or via other secondary displays. In this configuration, the gaming machines 3000*a-d* and the bonus displays 3002*a,b* is linked in communication with one another.

In a preferred embodiment of the invention, the bonus event comprises a symbol matching or Bingo-like event such as that described above, which event further comprises a feature which permits winning combinations to be achieved across multiple sets of player game indicia, such as a plurality of different players' game number matrices.

Figure 15A:
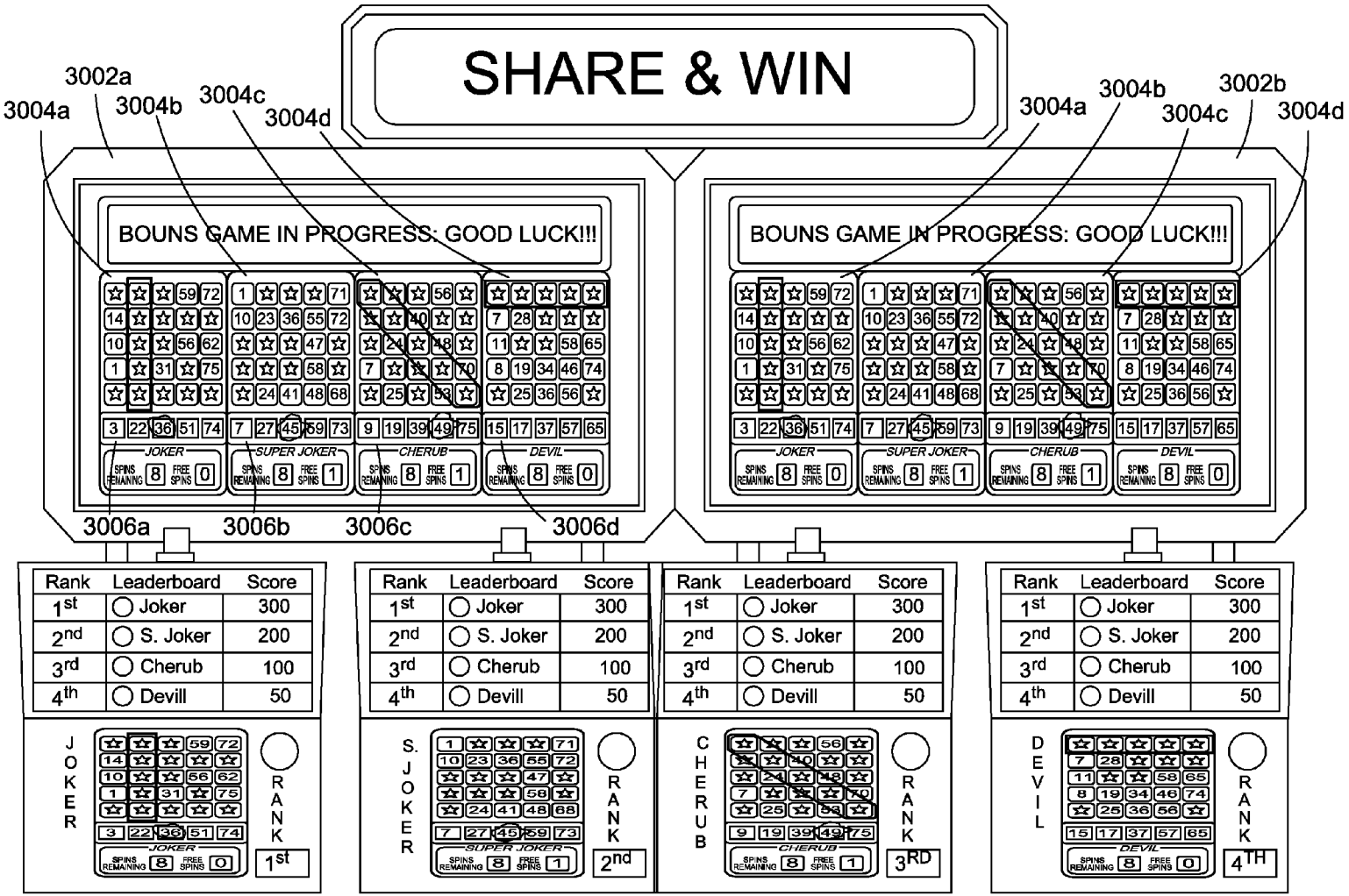
FIGS. 15A-15K illustrate examples of multi-player game play in accordance with an embodiment of the invention.

In one embodiment of the invention as illustrated in FIG. 15A, when the bonus event is initiated, at least two matrices are displayed. Preferably, a matrix is displayed corresponding to each gaming device 3000*a-d*. Thus, in the illustrated embodiment, four matrices 3004*a-d* are displayed. These matrices 3004*a-d* preferably display numbers or other symbols in like manner to the matrices 104, 106, 108, 1110 described above.

In addition, sets of base symbols 3006*a-d* is displayed relative to the matrices 3004*a-d*. These base symbols 3006*a-d* comprise randomly displayed sets of numbers or other symbols in like manner to the numbers in the n display regions 102/120 as described above. In a preferred embodiment, a different set of base symbols 3006*a-d* is displayed relative to each matrix, but as with the embodiment described above, it is possible for one set of base symbols 3006*a-d* to correspond to more than one matrix.

In a preferred embodiment, once the bonus event begins, each player receives a plurality of "spins" of their base symbols 3006*a-d* for matching to their corresponding matrix 3004*a-d*, in like manner to that described above. The number of spins or turns may be fixed or be randomly determined within a range of spins each time the bonus event begins. In this arrangement, each player attempts to obtain patterns of matches of their base symbols to the game symbols in their matrix (preferably using positional comparison as described above). As indicated above, a winning outcome may comprise matches of all symbols in at least one row, at least one diagonal and/or at least one column of the game symbols in their matrix 3004*a-d*, i.e. a "Slingo". Such a configuration is illustrated in FIG. 15A where Player 1 has achieved a vertical Slingo of matches along the second column of their matrix 3004*a*, Player 3 has achieved a diagonal Slingo of machines through their matrix 3004*c*, and Player 4 has achieved a horizontal Slingo of matches along the top row of their matrix 3004*d*. Of course, players may be paid winnings, such as credits, for achieving such combinations.

As with the embodiments described above, certain of the base symbols may comprise not only numbers but other special symbols. Such special symbols might have various properties or effects, such as to cause the matching of all symbols in a particular column of the player's matrix or the like.

Most importantly, however, and in a preferred embodiment of the invention, players may achieve winning results by achieving patterns of matches which span multiple of the matrices 3004*a-d*. Preferably, such patterns comprise combinations of matches of two or more rows or two or more diagonals.

Figure 15B:
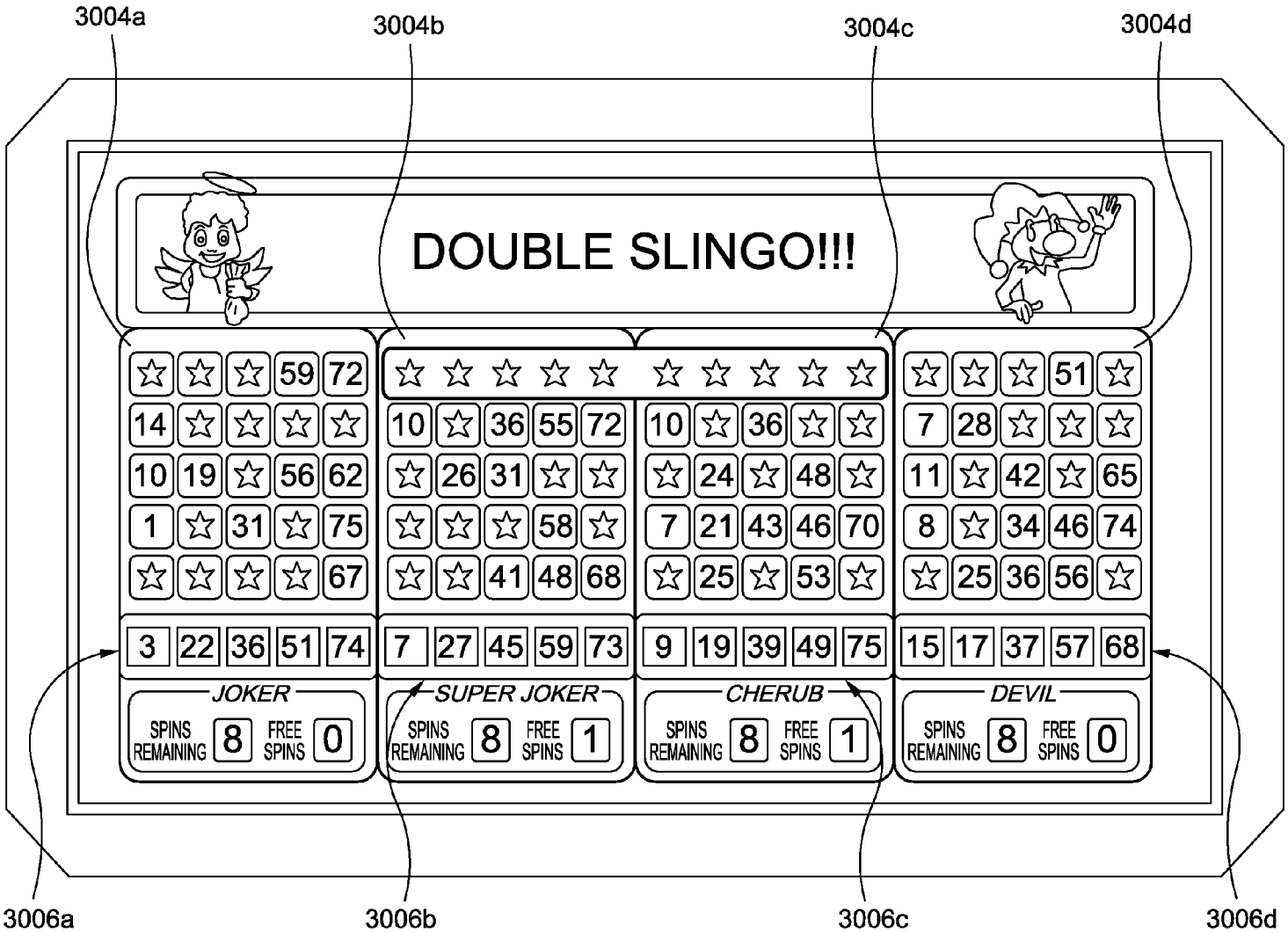
Figure 15C:
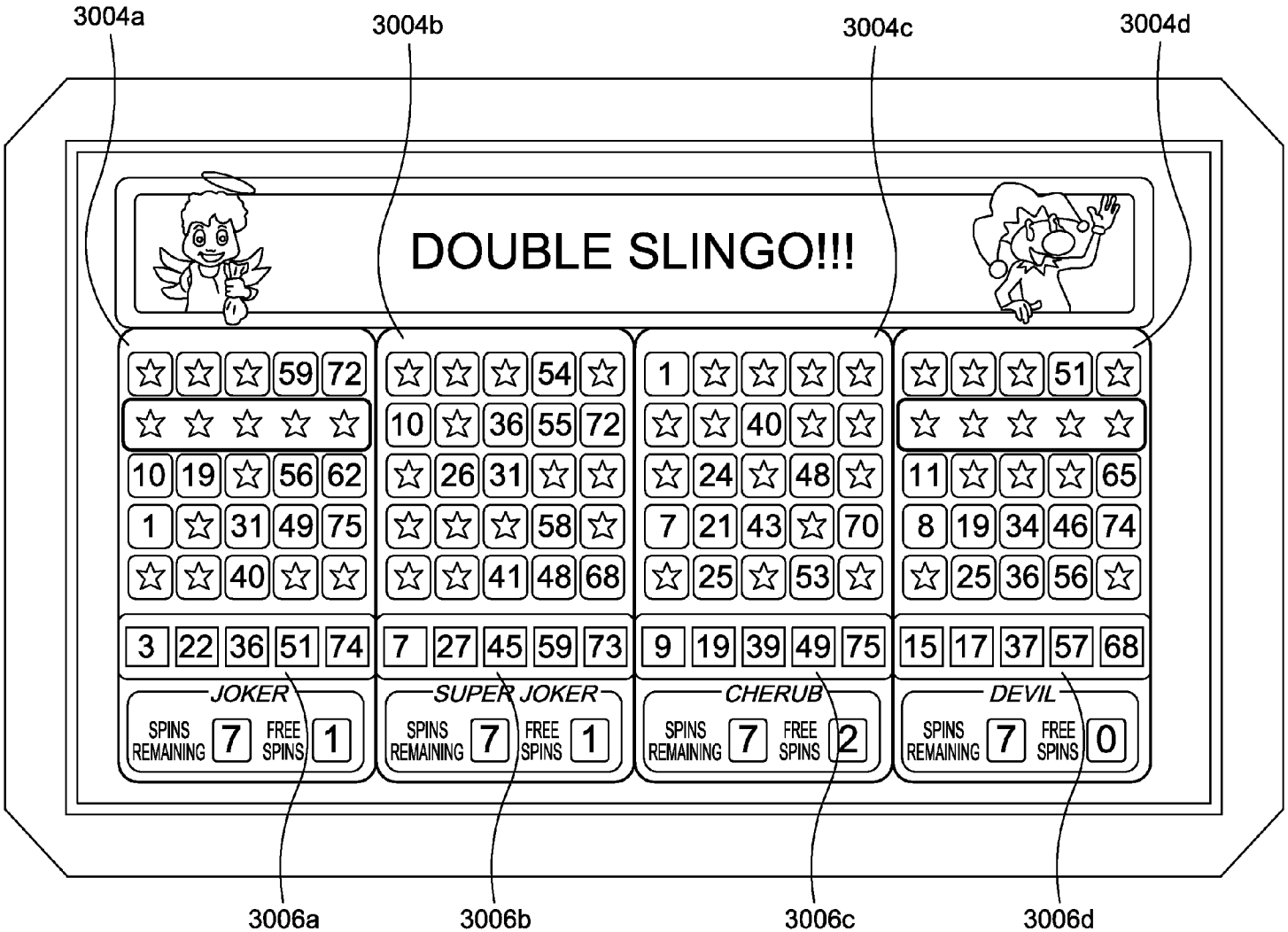

For example, a winning outcome may be declared if all symbols are matched along contiguous rows of two players' matrices. FIGS. 15B and 15C illustrate examples of such a winning combination. As illustrated in FIG. 15B, Player 2 has achieved a horizontal Slingo along the top row of their matrix 3004*b* and Player 3 has achieved a horizontal Slingo along the top row of their matrix 3004*c*. Because the two rows of matches are contiguous (i.e. uninterrupted matches of all symbols along the aligned rows of those adjacent matrices), a "Double Slingo" winning outcome has been declared.

In a preferred embodiment, the matrices 3004*a,d* at either end are treated as being adjacent to the other (as if the matrices were wrapped around a cylinder). Thus, as illustrated in FIG. 15C, Players 1 and 4 may achieve a Double Wrap Around Slingo by matching all symbols in aligned rows of their matrices 3000*a,d*.

Figure 15D:
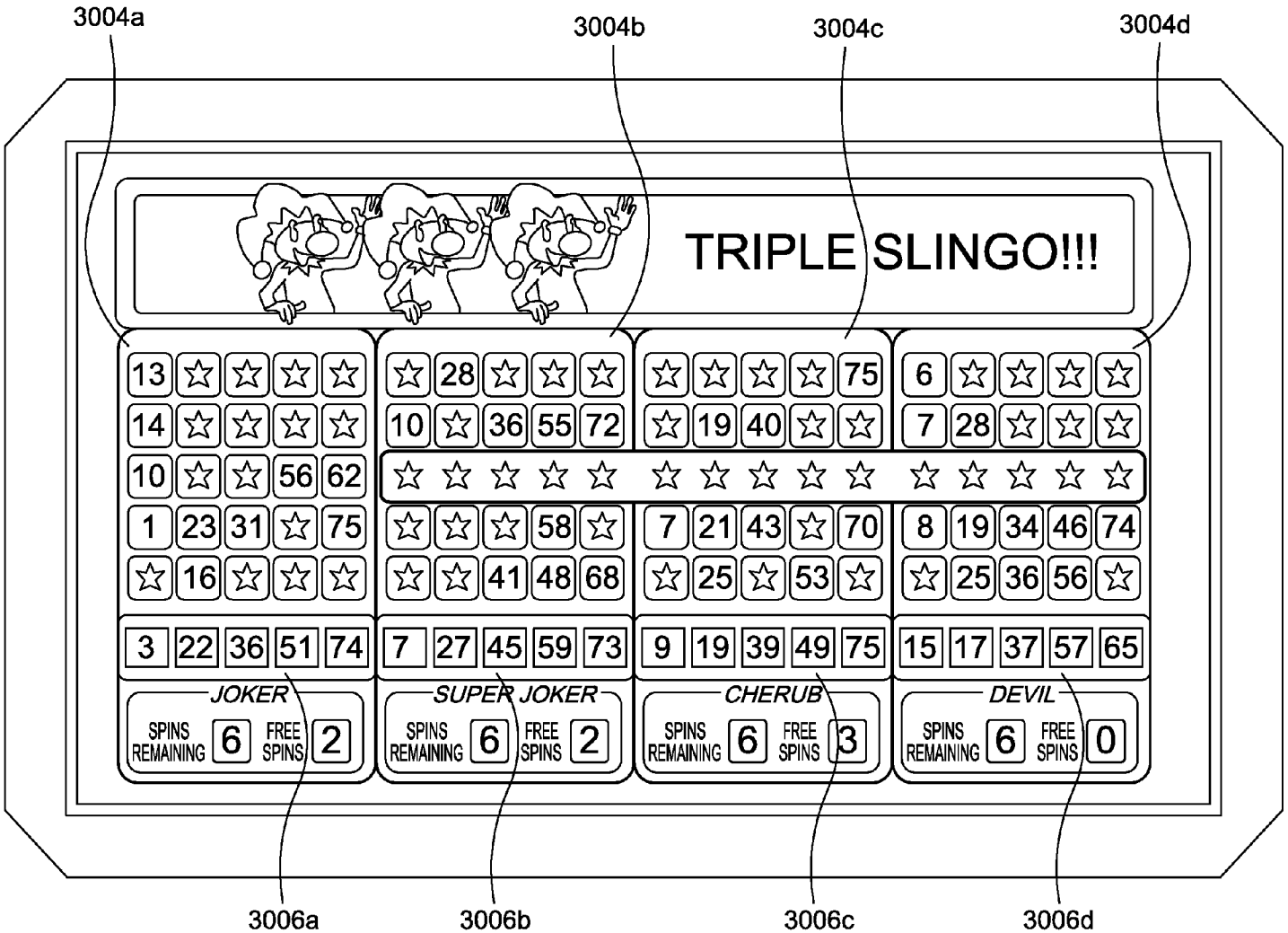
Figure 15E:
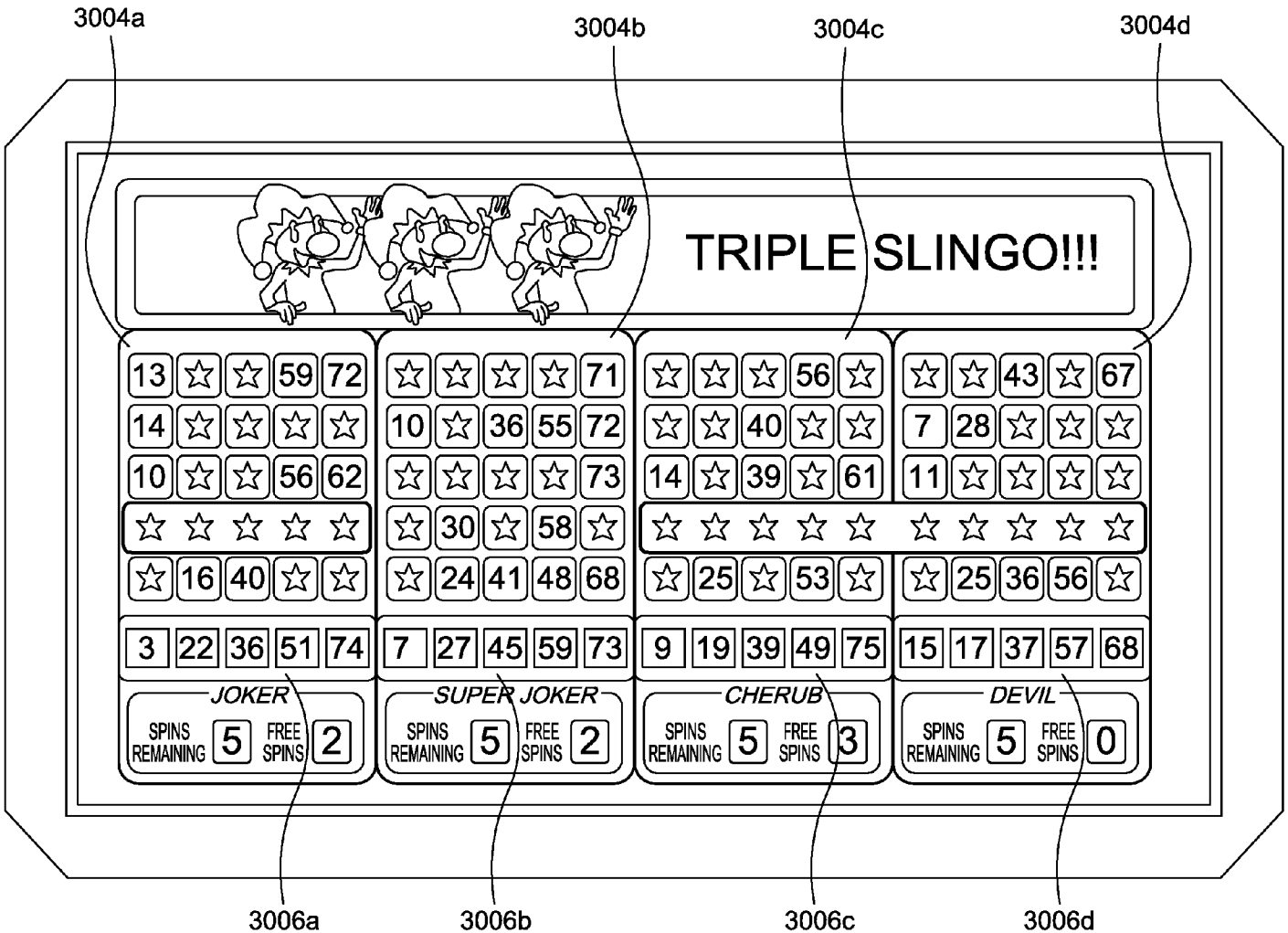

As another example, a winning outcome may be declared if all symbols are matched on contiguous rows of three players' matrices. FIGS. 15D and 15E illustrate examples of such a winning combination. As illustrated in FIG. 15B, Players 2, 3 and 4 have each matched all of the symbols in the third row of their matrices 3004*b-d*. Because the three rows of matches are contiguous (i.e. in direct un-interrupted line), a "Triple Slingo" winning outcome has been declared.

Likewise, as illustrated in FIG. 15E, players might achieve a Triple Wrap Around Slingo when contiguous rows of symbols are matched and continuity includes three total matrices including both the first and fourth matrix 3004*a,d* (such as matches along contiguous rows of the third 3004*c*, fourth 3004*d* and back to the first matrix 3004*a*, as illustrated, or along contiguous rows of the fourth 3004*d* and then back to the first 3004*a* and second 3004*b* matrix.).

Figure 15F:
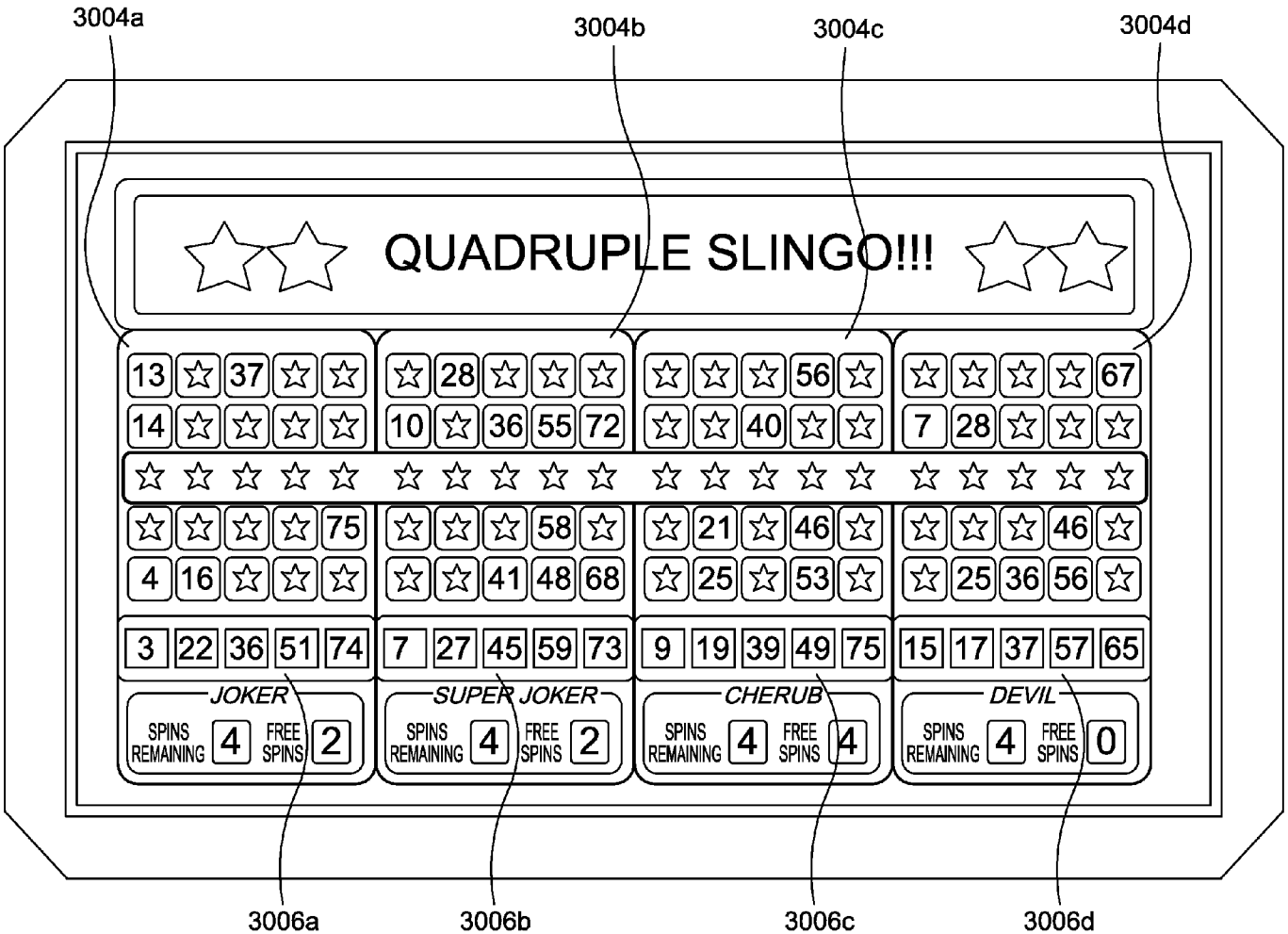

As yet another example, a wining outcome may be declared in all symbols are matched on contiguous rows of all four players' matrices 3004*a-d*. One example of such a configuration is illustrated in FIG. 15F wherein all four players have achieved matches of all the symbols along the third row of each of their matrices 3004*a-d*.

Figure 15G:
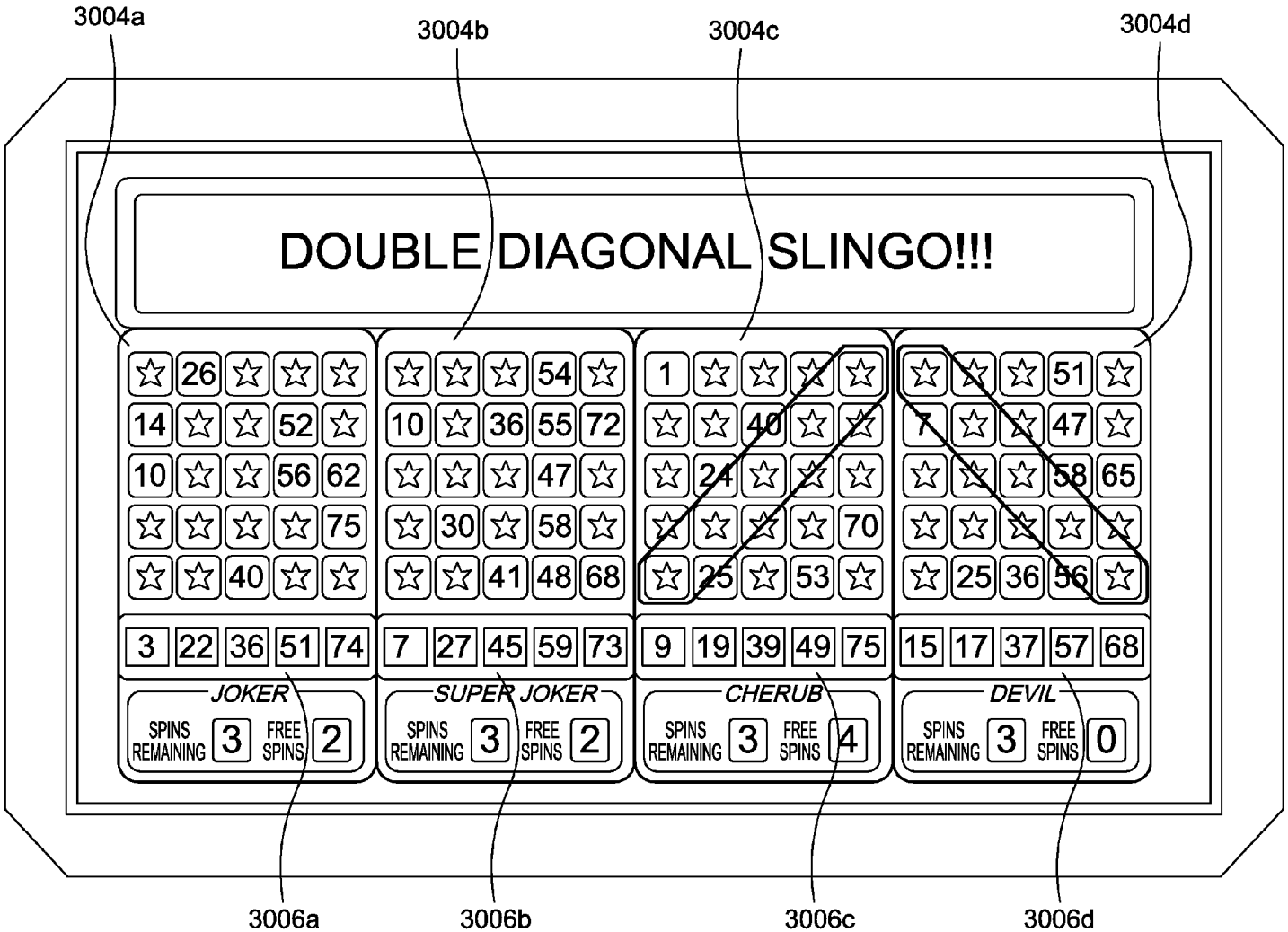

As indicated above, winning combinations may be achieved for contiguous diagonal matches. One such example is illustrated in FIG. 15G wherein Players 3 and 4 have achieved a Double Diagonal Slingo. This result was achieved because the two players each achieved a diagonal Slingo and those two diagonals touched or were contiguous with one another (note that in a preferred configuration such a combination would not have been achieved if the two players had both achieved diagonal Slingos which went the same direction). As with the "row" Slingos, diagonal Slingos might be declared when they wrap between the first and last matrix 3004*a,d*.

Figure 15H:
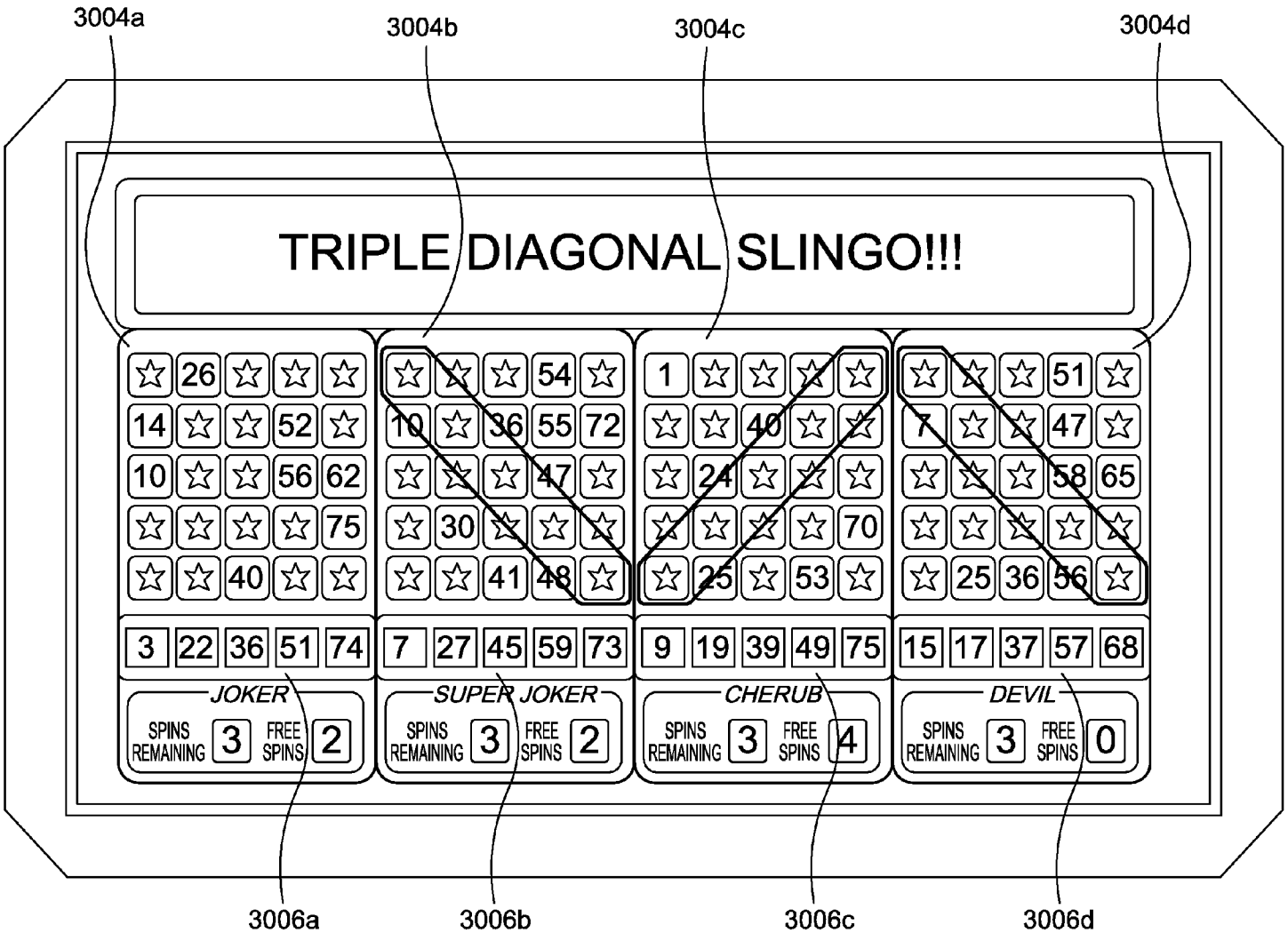
Figure 15I:
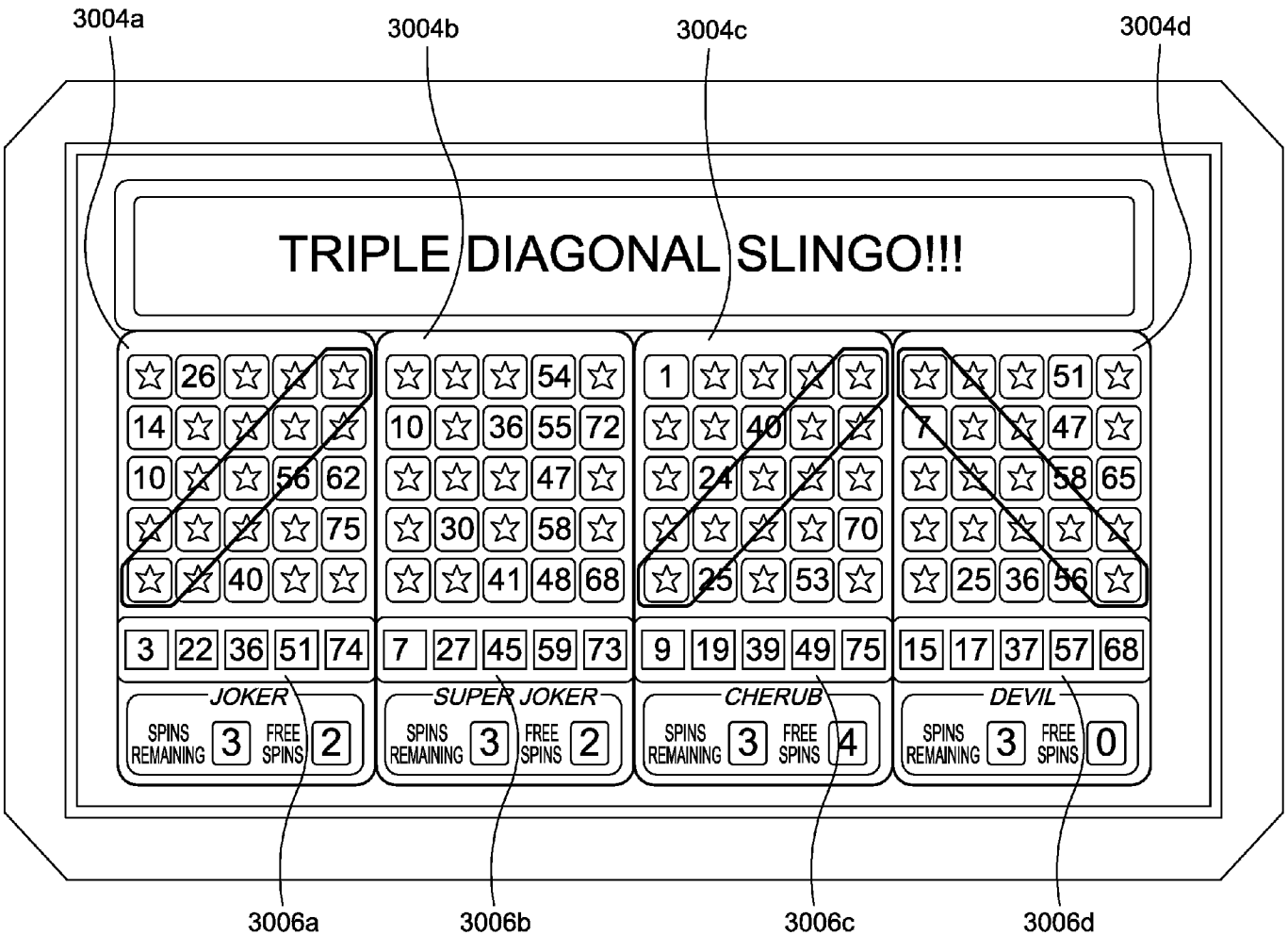

As yet another example, a Triple Diagonal Slingo may be declared when three diagonal Slingos are obtained and they are contiguous. One example of such a configuration is illustrated in FIG. 15H wherein Players 2, 3 and 4 have each achieved an individual diagonal Slingo and those Slingos touch or are contiguous Likewise, FIG. 15I illustrates an example of a Triple Diagonal Wrap Around Slingo where three diagonal Slingos were achieved and two of those wrapped from the last to the first matrix 3004*a,d*.

Figure 15J:
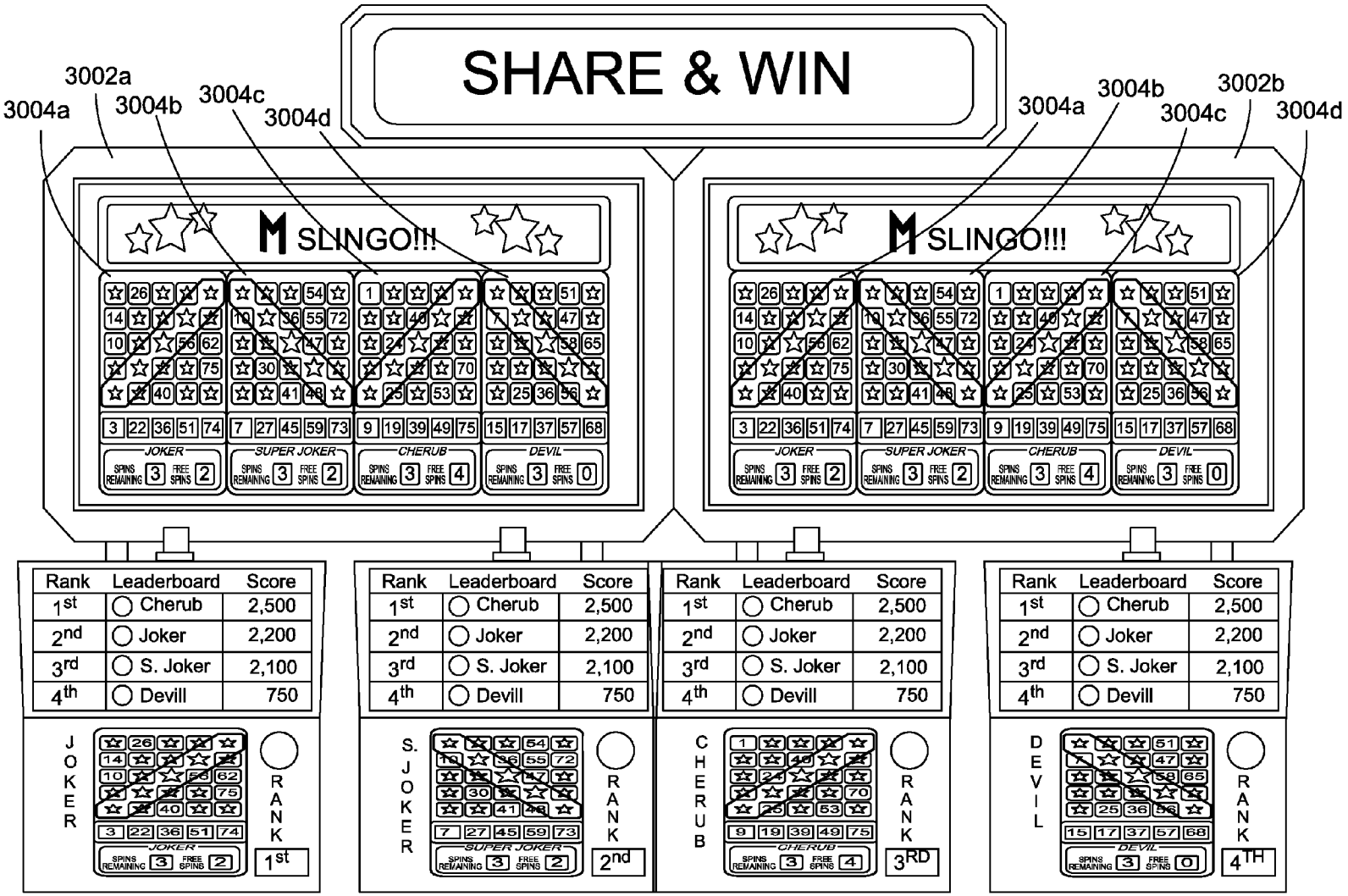
Figure 15K:
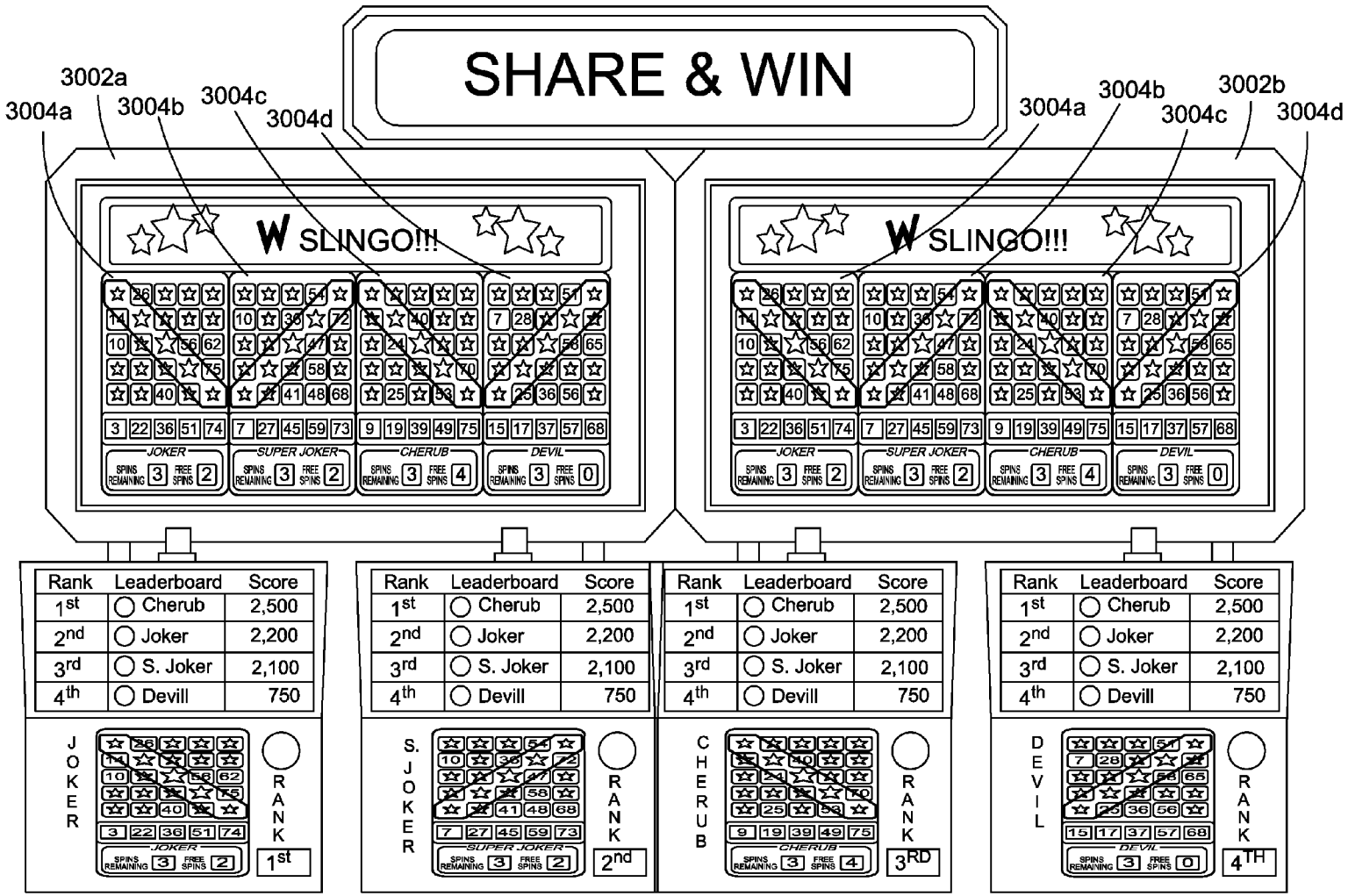

FIGS. 15J and 15K illustrate other unique embodiments of contiguous diagonal Slingos. As illustrated in FIG. 15J, the combination of diagonal Slingos may form an "M" pattern (wherein the diagonal matches are linked at their ends, starting with a rising diagonal Slingo on the first matrix 3004*a*). As illustrated in FIG. 15K, the combination of diagonal Slingos may form a "W" pattern, (wherein the diagonal matches are linked at their ends, starting with a falling diagonal Slingo.

In one embodiment, the awards for different winning combinations may vary. For example, the award for harder to achieve or less probable combinations may be higher than those for easier to achieve or more probable combinations. As one example, the award for a winning Double Slingo may be less than the win for a Triple Slingo.

As indicated, when an individual player achieves a winning pattern of matches relative to their own matrix 3004*a-d*, such as a base Slingo outcome, they may be paid winnings, such as points or credits. In addition, each player whose matrix forms a part of a contiguous winning combination may participate in or receive winnings. For example, relative to the example illustrated in FIG. 15B, Players 2 and 3 may be awarded winnings for their individual diagonal Slingos, but also may be awarded winnings for their joint formation of a Double Slingo (which award is not provided to Players 1 and 3).

In one embodiment, each player plays their spins or turns until either the player matches all of the symbols in their matrix 3004*a-d* (a "full card") or they have exhausted their turns. In one embodiment, for example, once an individual player's card is fully matched, that player's matrix may be blacked out or taken off of the display and can no longer be used in combination with the other matrices to form winning combinations. In a preferred embodiment, matching cards continue to be displayed so that they may continue to be used to form winning outcomes with other of the matrices. In one embodiment, individual players might be awarded free or additional spins (such as by revealing them from under a matched symbol in their matrix). In this arrangement, the players may end up having different numbers of spins or turns.

In one embodiment, each player is awarded the points or credits which they collect or achieve during the play of the bonus event. For example, an individual player might achieve an individual Slingo and be paid 100 credits and then later achieve a Triple Slingo with two other players and be paid 200 credits, for a total award of 300 credits.

In addition, as with the game described earlier, individual players might win other awards, such as by revealing Gold Coins or the like during the play of their individual matrix.

In one embodiment, a bonus award may be paid based upon the outcome or ranking of each player's winning at the end of the bonus event. For example, the player who received the highest aggregate points or credits during the bonus event might be paid a bonus ranking award of 2500 credits, the second ranked player might receive 750 credits, the third ranked player might receive 500 credits, and the lowest or last ranked player might receive 250 credits. Of course, not all players necessarily have to be paid a ranking bonus (for example, only the highest ranked player might receive the bonus). Further, the amounts of the awards might vary.

In one embodiment, the size of the rank bonus or individual outcome awards might depend upon an award multiplier which the player pays for at the beginning of the bonus event. For example, at the beginning of the bonus event, each player might be given the opportunity to place a 1 credit wager up to a maximum credit wager, such as 5 credits. The size of the player's wager may be used as a multiplier or otherwise change the size of awards for winning outcomes. In other embodiments, the size of a multiplier or the like may be determined by the size of the player's wager in the base game.

In the above example, four players were playing the four gaming devices 3000*a-d* and thus participated in the bonus event. In one embodiment, the bonus event can be triggered and played by a minimum of one active player. In such an embodiment, the other matrices may be "played" by the computer or gaming device. In such an embodiment, of course, the other gaming devices then do not collect winnings. However, by activating the other matrices and playing them, the single player can participate in outcomes which span multiple matrices.

In other embodiments, the game need not be presented as a bonus event. For example, the game might simply be presented as a base game in similar fashion to that described above.

The game or bonus event might have other formats or variations. For example, instead of four players each playing a single matrix, two players might play a single matrix. In another example, two players might each play more than one matrix. Relative to the variation illustrated in FIG. 4, a first player might play matrices 104 and 106, while a second player might play the matrices 108 and 110.

Also, the plurality of matrices may be arranged in various configurations, thus permitting different arrangements of contiguous matches through multiple player matrices. For example, relative to the configuration illustrated in FIG. 4, the two players might cooperate to create an "X" Slingo through the diagonals of all four matrices. In embodiments where the players' matrices are stacked vertically, the players might cooperate to generate "vertical" Slingos. For example, instead of having four matrices arranged horizontally, four player matrices might be stacked vertically and then the players might cooperate to define double, triple or quadruple vertical Slingos.

As indicated herein, the games of the invention are preferably played with numbers. However, the games could be played with other indicia, such as symbols.

While the player symbols are preferably displayed in matrix format, they could be displayed in other fashions, such as in a pyramid or other grids, etc. As also indicated above, the number of player symbols may vary and do not have to comprise 25 symbols in a 5×5 matrix.

Alternate variations on the game can be made. For example, one can vary the occurrence of the symbols which can be displayed by the display regions 102 and 120, as well as the minimum or maximum bet per card allowed and/or the amount of credits awarded for the various winning combinations.

In one embodiment, the random or "base" symbols/numbers 102, 3006 (which the one or more players attempt to match to the player or game symbols/numbers) may be generated in various manners. For example, instead of using a random number generator, game elements might be selected. For example, a set of physical game balls might be used. Where the game is played using numbers 1-75, 75 game balls each bearing one of the numbers from 1-75 might be used. The balls might be drawn or selected using a ball blower or other random ball selection device. Of course, other game elements might be utilized.

Figure 16:
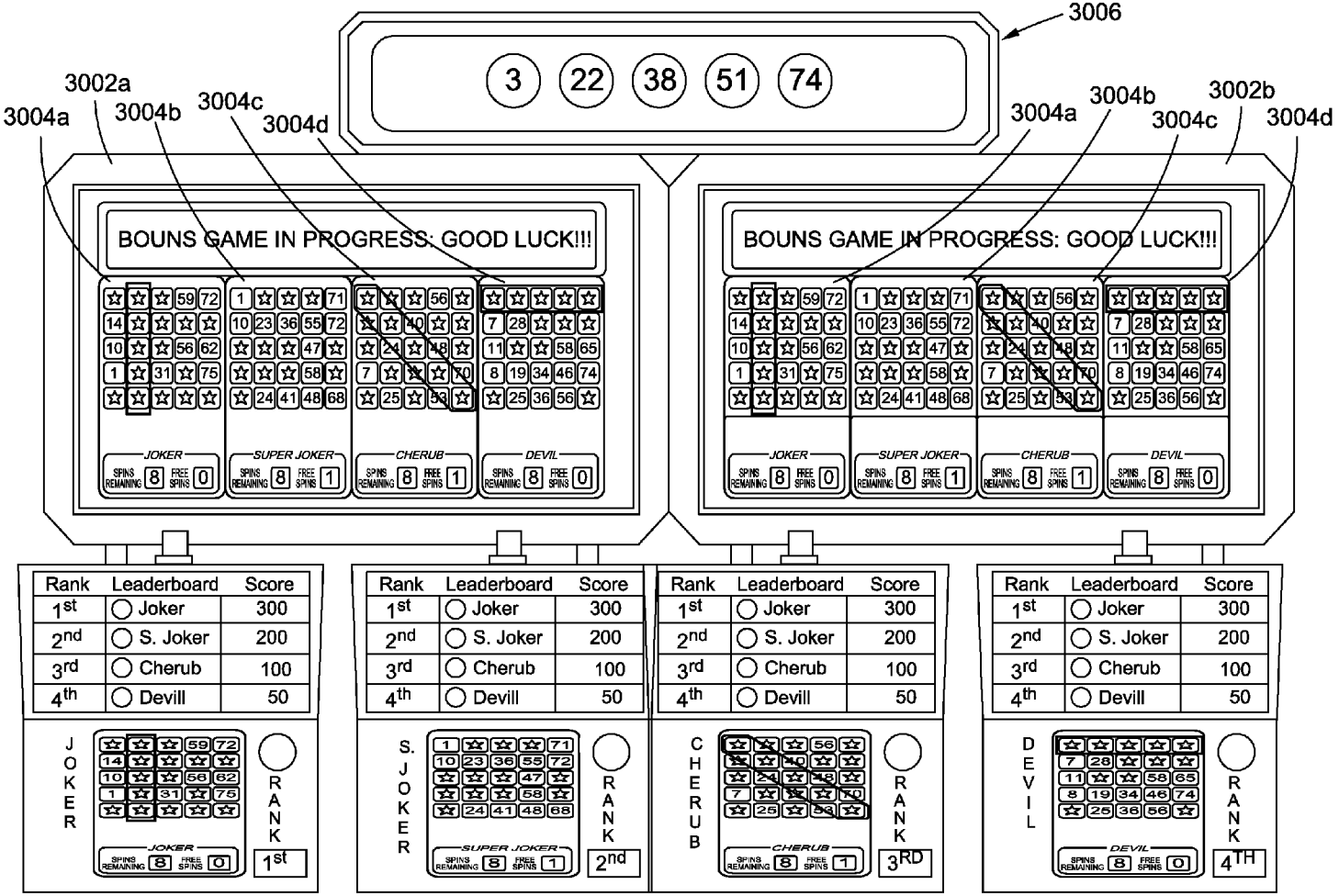
FIG. 16 illustrates an example of a game of the invention where base symbols may be used by more than one player and may be generated by ball selection.

In one embodiment, the same base symbols 102 might be used by a single player relative to two or more sets or matrices of player symbols, or by more than one player of the game, rather than providing different base symbols 102 for each player. For example, in the example illustrated in FIG. 15A, a first player has received a set of base symbols 3, 22, 36, 51 and 74, while a second player has received a set of base symbols 7, 27, 45, 59, and 73. In one embodiment, a single set of base symbols 3006*a*, such as 3, 22, 36, 51 and 74 might be selected (such as using an RNG, by ball draw or otherwise) and each player might initially attempt to match this set of base symbols to their player or game symbols, as illustrated in FIG. 16. Then another set of base symbols might be selected and all of the players might attempt to match those base symbols to their player or game symbols Likewise, one or more sets of base symbols, such as the set 3, 22, 36, 51 and 74 might be matched against two or more matrices of player numbers which are being played by a single player (rather than having different sets of symbols or numbers for matching against different matrices of player numbers or symbols).

In one embodiment, sets of base symbols 102, 3006 might be selected such that one base symbol is selected from each sub-set of base symbols. For example, in the embodiment where a player number matrix has a first column in which randomly selected numbers between 1-15 may be displayed, a second column in which randomly selected numbers between 16-30 may be displayed, a third column in which randomly selected numbers between 31-45 may be displayed, etc., sets of base symbols 102, 3006 might be selected wherein each set comprises one number from the first group of numbers 1-15, one number from the second group of numbers 16-30, and so on.

In such a configuration, all players of the game might play the same sets of base symbols 102, 3006, so long as their spins permit. For example, assume that Player 1 has 3 spins and Player 2 has 2 spins. A first set of base symbols 102, 3006, might be called, such as 3, 22, 38, 51 and 74. Both players attempt to match their player numbers to these numbers. At that point, Player 1 has 2 remaining spins or plays and Player 2 has 1 remaining spin or play. A second set of base symbols 102, 3006 is then called, such as 7, 27, 45, 59 and 73. Both players attempt to match their player numbers to these numbers. At that point, Player 1 has 1 remaining spin and Player 2 has no remaining spins. A third set of base symbols 102, 3006 is then called, such as 9, 19, 39, 49 and 75. Because only Player 1 had a spin left, only Player 1 is permitted to attempt to match their player numbers to these numbers.

In some embodiments of the invention, it is possible for the game to be played without spins. For example, the game may be played in a manner in which all players play against the same number of called or selected base symbols 102, 3006. For example, the game might be played until one player receives a certain game-ending matching pattern or another game ending event occurs. In other embodiments, as indicated, players might start with the same initial number of spins but might be awarded additional spins or plays during play of the game, such as by the selection of special symbols.

In other embodiments, the base symbols 102, 3006 might comprise one or more symbols selected from the entire set. For example, base symbols 102, 3006 might comprise a sequence of numbers randomly selected from the set of numbers 1-75. In such a configuration, two consecutive selected numbers might be selected from the set of numbers which corresponds to a single column or area of the player numbers. For example, the base symbols 102, 3006 might comprise the randomly selected numbers 3, 8 and 11, even though all of those numbers fall into the range 1-15 and thus could only be matched to a player's numbers in the first column of their matrix (in the situation where the players number in the first column of the matrix are only selected from the numbers 1-15).

As will become readily apparent to those skilled in the art, variations of the present method and device can be designed and built without departing from the scope of the claimed disclosure. For example, various embodiments can be fully incorporated into software and played on a computer or similar device.

Accordingly, while the disclosed device and method have been particularly shown and described with reference to the preferred embodiments, it is understood by those skilled in the art that various modifications in form and detail may be made therein without departing from the scope and spirit of the present disclosure.

What is claimed is:

1. A method for playing a Bingo-like game by at least two players comprising the steps of:

displaying a graphic user interface (GUI) including:

at least a first n column by m row random symbol display matrix corresponding to a first player, wherein n is at least 2, and wherein each first display matrix has number of display positions defining multiple rows, multiple columns and multiple diagonals; and at least a second n column by m row random symbol display matrix corresponding to a second player, wherein n is at least 2, and wherein each second display matrix has number of display positions defining multiple rows, multiple columns and multiple diagonals;

wherein at least one of said first matrices and at least one of said second matrices are positioned so that they have at least one row, at least one column or at least one diagonal aligned with one another;

generating and displaying player symbols in said at least one first and at least one second matrix;

displaying a plurality of base symbols for potential matching to said symbols of said at least one first and at least one second random symbol display matrix;

comparing the base symbols with the symbols displayed in the at least one first and second matrices; and determining whether all of the symbols along any contiguous rows, columns or diagonals of at least one first matrix of said first player and at least one second matrix of said second player are matched and, if so, declaring a winning result.

2. The method in accordance with claim 1 wherein said first random symbol display matrix corresponding to said first player and said second random symbol display matrix corresponding to said second player are arranged so that the columns thereof are aligned vertically.

3. The method in accordance with claim 1 wherein said first random symbol display matrix corresponding to said first player and said second random symbol display matrix corresponding to said second player are arranged so that the rows thereof are aligned horizontally.

4. The method in accordance with claim 1 wherein n=5.

5. The method in accordance with claim 1 comprising displaying at least one set of n base symbols having n positions.

6. The method in accordance with claim 5 wherein said player symbols and base symbols are selected from the group consisting of: a first set of random numbers ranging from 1 to 15 for n=1; a second set of random numbers ranging from 16 to 30 for n=2; a third set of random numbers ranging from 31 to 45 for n=3; a fourth set of random numbers ranging from 46 to 60 for n=4; and a fifth set of random numbers ranging from 61 to 75 for n=5.

7. The method in accordance with claim 6 comprising comparing the base symbols in each of said n positions with the symbols displayed in corresponding n columns of each row of said corresponding at least one first and second matrices.

8. The method in accordance with claim 1 wherein said the displaying, generating, comparing and determining steps are implemented in software and operated on a computer system, a handheld computing device or slot machine.

9. The method in accordance with claim 1 further comprising the step of receiving a wager from said first player and said second player.

10. The method in accordance with claim 1 further comprising awarding an award to said first and second players in the event of a winning result.

11. The method in accordance with claim 1 wherein said player symbols and said base symbols comprise numbers selected randomly from a set of numbers.

12. The method in accordance with claim 1 wherein n=5 and m=5.

13. The method in accordance with claim 1 further comprising the step of declaring a winning result and awarding an award to said first player if at least one predetermined pattern of matches as to said at least one first display matrix corresponding to said first player, regardless of whether all symbols along any contiguous rows, columns or diagonals of said at least one first matrix of said first player and said at least one second matrix of said second player are matched.

14. The method in accordance with claim 1 further comprising the step of declaring a winning result and awarding an award to said second player if at least one predetermined pattern of matches as to said at least one second display matrix corresponding to said second player, regardless of whether all symbols along any contiguous rows, columns or diagonals of said at least one first matrix of said first player and said at least one second matrix of said second player are matched.

15. A method for playing a Bingo-like game by at least one player comprising the steps of:

displaying a graphic user interface (GUI) including:

at least a first n column by m row random symbol display matrix, wherein n is at least 2, and wherein each first display matrix has number of display positions defining multiple rows, multiple columns and multiple diagonals; and at least a second n column by m row random symbol display matrix, wherein n is at least 2, and wherein each second display matrix has number of display positions defining multiple rows, multiple columns and multiple diagonals;

wherein at least one of said first matrices and at least one of said second matrices are positioned so that they have at least one row, at least one column or at least one diagonal aligned with one another;

generating and displaying player symbols in said at least one first and at least one second matrix;

displaying a plurality of base symbols for potential matching to said symbols of said at least one first and at least one second random symbol display matrix;

comparing the base symbols with the symbols displayed in the at least one first and second matrices; and determining whether all of the symbols along any contiguous rows, columns or diagonals of said at least one first matrix and at said least one second matrix are matched and, if so, declaring a winning result.

16. The method in accordance with claim 15 wherein said first random symbol display matrix and said second random symbol display matrix are arranged so that said columns thereof are aligned vertically.

17. The method in accordance with claim 15 wherein said first random symbol display matrix and said second random symbol display matrix are arranged so that said rows thereof are aligned horizontally.

18. The method in accordance with claim 15 wherein n=5.

19. The method in accordance with claim 15 comprising displaying at least one set of n base symbols having n positions.

20. The method in accordance with claim 19 wherein said player symbols and base symbols are selected from the group consisting of: a first set of random numbers ranging from 1 to 15 for n=1; a second set of random numbers ranging from 16 to 30 for n=2; a third set of random numbers ranging from 31 to 45 for n=3; a fourth set of random numbers ranging from 46 to 60 for n=4; and a fifth set of random numbers ranging from 61 to 75 for n=5.

* * * * *